US007832718B2

(12) United States Patent
Fukasawa et al.

(10) Patent No.: US 7,832,718 B2
(45) Date of Patent: Nov. 16, 2010

(54) SHEET POST PROCESSING APPARATUS AND IMAGE FORMING SYSTEM

(75) Inventors: Eiji Fukasawa, Yamanashi-ken (JP); Ichitaro Kubota, Kofu (JP); Kenichi Matsuno, Kofu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 16 days.

(21) Appl. No.: 12/073,076

(22) Filed: Feb. 29, 2008

(65) Prior Publication Data

US 2008/0265484 A1 Oct. 30, 2008

(30) Foreign Application Priority Data

| | | |
|---|---|---|
| Apr. 26, 2007 | (JP) | 2007-116995 |
| Apr. 26, 2007 | (JP) | 2007-116996 |
| Apr. 26, 2007 | (JP) | 2007-116997 |
| Apr. 26, 2007 | (JP) | 2007-116998 |
| Jun. 27, 2007 | (JP) | 2007-169021 |

(51) Int. Cl.
*B65H 33/04* (2006.01)
*B65H 39/00* (2006.01)

(52) U.S. Cl. ..... 270/58.07; 270/58.08; 270/58.09; 270/58.11; 270/58.12; 270/58.17

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | | |
|---|---|---|---|---|
| 5,443,248 | A * | 8/1995 | Hayashi et al. | 270/58.09 |
| 5,673,906 | A * | 10/1997 | Furuya et al. | 270/58.14 |
| 5,735,515 | A * | 4/1998 | Hayashi et al. | 270/58.11 |
| 2005/0121848 | A1* | 6/2005 | Kodama et al. | 270/58.12 |
| 2005/0152725 | A1* | 7/2005 | Mochizuki | 399/410 |

FOREIGN PATENT DOCUMENTS

| | | |
|---|---|---|
| JP | H05-155176 | 6/1993 |
| JP | H09-188470 | 7/1993 |
| JP | 2001-158564 | 6/2001 |
| JP | 2002-128375 | 5/2002 |
| JP | 2003-089464 | 3/2003 |
| JP | 2003089464 A * | 3/2003 |

* cited by examiner

*Primary Examiner*—Gene Crawford
*Assistant Examiner*—Yolanda Cumbess
(74) *Attorney, Agent, or Firm*—Manabu Kanesaka

(57) ABSTRACT

A sheet post processing apparatus of compact shape with good alignment can be obtained by providing an accumulation tray for aligning and accumulating sheets successively delivered, a post processing unit for performing a post process such as binding to a sheet stack accumulated on the accumulation tray, and a grip unit for gripping the post processed sheet stack. The post processing unit enables the accumulation tray to reciprocate in a direction transverse to a discharging direction of a sheet discharge tray. The grip unit has a grip part for gripping the sheet stack, a guide part for reciprocally guiding the grip part back and forth in the sheet discharging direction. The grip part is separable from the guide part during a movement of the post processing unit.

20 Claims, 24 Drawing Sheets

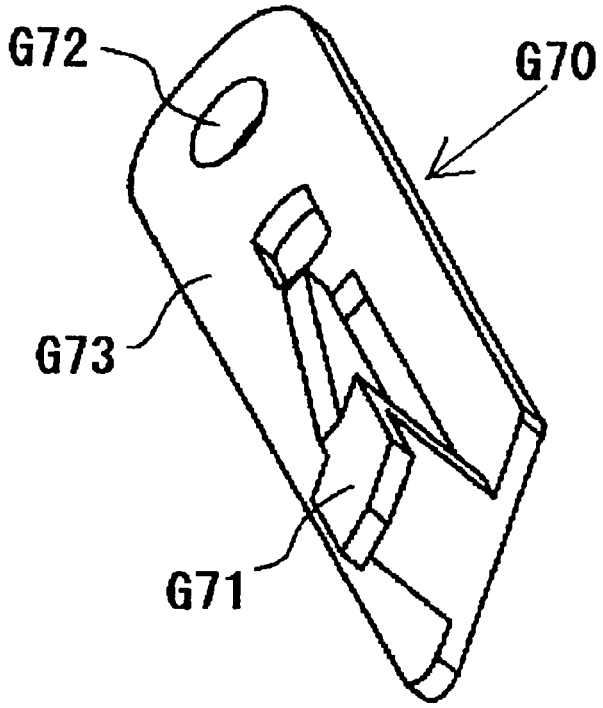
Fig. 13
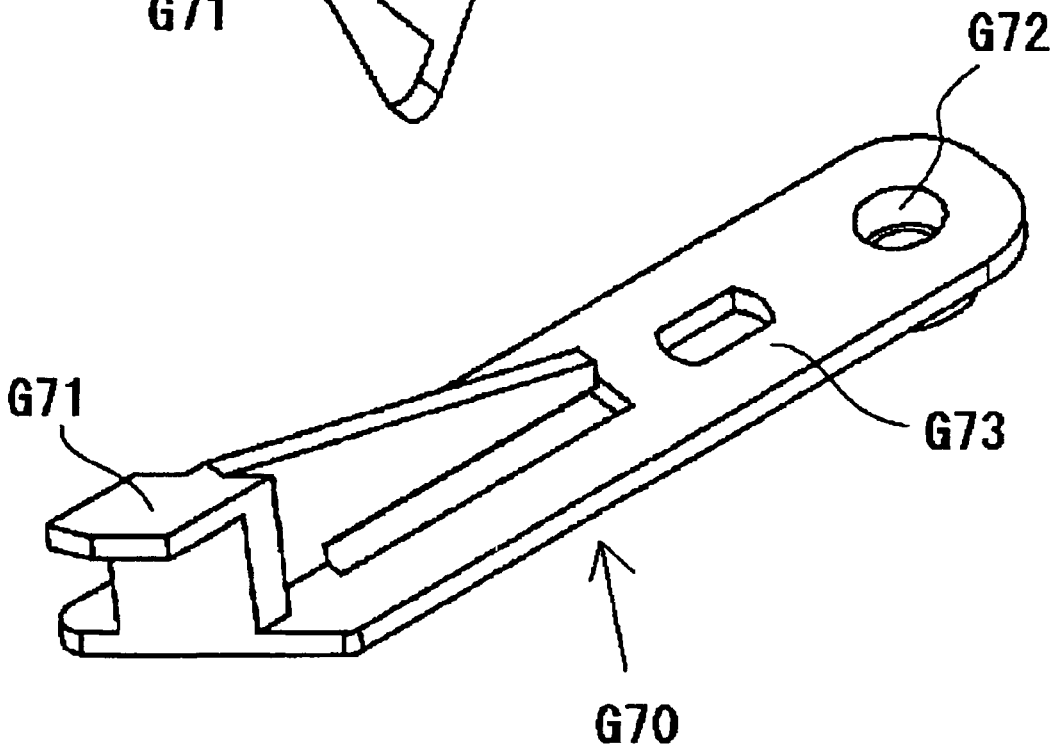

SHEET POST PROCESSING APPARATUS AND IMAGE FORMING SYSTEM

BACKGROUND OF THE INVENTION AND RELATED ART STATEMENT

The present invention relates to a sheet post processing apparatus which accumulates sheets discharged from a copying apparatus or an image forming apparatus such as a printer, carries out binding process as stapling on sheet stacks, or alternatively offsets the sheet stacks per each of predetermined widths, and an image forming system having the sheet post processing apparatus.

The sheet post processing apparatus which disposes a process tray at an upstream side of a sheet discharge tray, aligns to accumulate the sheets delivered from the image forming apparatus on the process tray, carries out the post process as stapling on the accumulated sheet stacks, grips the sheet stacks by grip means (grippers), and discharges the sheet stacks on the discharge tray, has conventionally been known.

Japanese Patent Laid Open No. 2001-158564 (hereinafter "Patent Literature 1") discloses the sheet post processing apparatus which disposes a staple tray 121 corresponding to the process tray at the upstream side of the discharge tray 112, accumulates the sheets delivered from the copying apparatus 2, carries out the stapling process on the accumulated sheet stacks by the staple apparatus 111, and thereafter pushes the sheet stacks at their back ends by a discharge pawls 110*a* corresponding to the grippers, thereby discharging the sheets on the discharge tray.

Further, Japanese Patent Laid Open No. 2003-89464 (hereinafter "Patent Literature 2") discloses the sheet post processing apparatus where a grip means 21 circulating along rail grooves 3*a* discharges the sheet stacks accommodated in a sheet accumulation plate 5 to a stacker tray 4 being the discharge tray from the sheet accumulation plate 5.

Further, Japanese Patent Laid Open Hei No. 5-155176 (hereinafter "Patent Literature 3") discloses the sheet post processing apparatus which, for carrying out the stapling process to the sheet stacks discharged and accumulated on a multi-stepped tray 1, uses a stapler assembled body 10 and gripper assembled bodies 11 mounted, as one body, on a supporter vertically moved by a motor 20, grips the sheet stacks discharged and accumulated on the tray 1 by a pair of gripping arms 28, 29 of the gripper assembled bodies 11, pulls the sheet stacks to the stapling position of the stapler assembled body 10, carries out the stapling process on the pulled sheet stacks, thereafter, again grips the stapling processed sheet stacks by the pair of gripping arms 28, 29 of the gripper assembled bodies 11, and returns to the original tray 1.

Still further, Japanese Patent Laid Open Hei No. 9-188470 (hereinafter "Patent Literature 4") discloses the sheet piling and fixedly binding apparatus, where the sheet stack 14 is pushed at the end by the sheet end pushing and regulating mechanism 12, the end positioning member enables to change the position for regulating the end part at the binding side of the sheet stack 14 in the direction crossing with the end of the sheet stack 14, and is connected to move together with the sheet end pushing and regulating mechanism 12. The moving sheet stack fixedly binding mechanism is installed for binding the piled sheet stacks at the desired positions almost in parallel with the fixedly binding end of the sheet stack. The end positioning member has the size smaller than that of the flange opening 44 of the stapler, so that the end positioning member passes the stapler and moves without colliding with the stapler.

Yet further, Japanese Patent Laid Open No. 2002-128375 (hereinafter "Patent Literature 5") discloses the accumulation apparatus where, when a blank material P becoming an under plate is delivered from a conveyor 2, a moving carriage 29 waiting backward of an end stopper 17 is directed to a conveyor exit. The delivered blank material is then received at the front end by a jaw portion 40 from an entrance and exit 43 and is supported at the underside by a supporter 44. As a support part 56 is pushed by the end of the blank material, lock pawls 53 are caused to hold the blank material. Further, when ending to hold the blank material, a sensor 60 causes the moving carriage 29 to be directed towards the waiting position with the same speed as the delivering speed of the conveyor, so that the jaw portion passes the end stopper. When the jaw portion passes the end stopper, the blank material collides with the end stopper, and the holding is released.

However, in the sheet post processing apparatus disclosed in Patent Literature 1, the staple apparatus 111 is moved to an appropriate position of the sheet stack whose back end is aligned by a back end fence 119, and after the sheet stack has been performed with the stapling process on a plurality of parts thereof, the stack is pushed by discharging pawls 110*a* on the sheet discharge tray, but since the sheet stack is merely dropped on the sheet discharge tray, there is a lack of proper alignment, which is drawback.

For moving the staple apparatus 111 to the appropriate position of the sheet stack, an apparatus mechanism is required for retracting the discharging pawls 110*a* from the moving range of the staple apparatus 111, and therefore, compacting of the apparatus is difficult.

Although, a substantially proper alignment can be obtained if the discharging pawls 110*a* is substituted by the sheet discharge mechanism by the grip means 21 disclosed in Patent Literature 2, such substitution may pose problems as outlined below.

A driving mechanism of the grip means 21 uses a circulating belt similar to a driving mechanism of the discharging pawls 110*a*of Patent Literature 1, and since the driving mechanism is always connected to the belt and turnably moves between the back of the staple position and the vicinity of an outlet of the sheet discharge tray, the grip means 21 are impossible to move. If a moving staple apparatus is mounted, the movement is disturbed, and, a control apparatus mechanism is required for retracting the grip means 21 from the moving range of the staple apparatus 111, and therefore, compacting of the apparatus is difficult.

Furthermore, if the moving staple apparatus is mounted on the discharging pawls 110*a* of Patent Literature 1 or the grip means 21 of Patent Literature 2, for solving the problem of disturbing the movement, and if the stapler assembled body 10 and the gripper assembled bodies 11 shown in Patent Literature 3 are made as a unit structure to move simultaneously, mutual hindrance while moving may be avoided. However, when the stapler assembled body 10 and the gripper assembled bodies 11 are made as a unit structure to move as disclosed in Patent Literature 3, the gripper assembled bodies 11 must be retreated within the moving range of the stapler assembled body 10. Further, under a condition where the sheets are once aligned and accumulated in a position different from the stapling position as mentioned above, the sheet stack is gripped by the grippers and pulled to the stapling position for the stapling process. Therefore, since the sheet stack is pulled to the stapling position, not only processing time is taken by this action, but also a proper stapling process cannot be performed since the aligned and accumulated sheet stack is broken down when pulling the sheet stacks to the stapling position.

Therefore, objects of the present invention are to obviate the above-mentioned drawbacks. Further, the present invention does not merely make a unit structure unified with the stapler means and the grip means, but rather divides into two functions of grip portions composing the grip means and a guide portion of guiding reciprocal movement of the grip portions. Further, according to the present invention, a cooperative and separable structure in association of the two functions with gripping actuation of the grip portions is provided. Further, according to the present invention, the grip portions are made as a unit structure unified with the stapler means, so that the above mentioned problems are solved.

Therefore, it is an object of the present invention to provide a sheet post processing apparatus where the grip means do not disturb a movement of the post processing means. Further, a sheet aligned condition is not broken down at the position of aligning and accumulating the sheets and a post process is possible within a short period of time. The grip means grip the post-processed sheet stack at the position of aligning and accumulating the sheets, and the sheet stack is discharged on a sheet discharge tray.

Further object of the present invention is to accomplish the below mentioned objects in the above mentioned sheet post processing apparatus and providing an image forming system having the same.

According to the present invention, the sheet post processing apparatus of a simple and compact mechanism is provided, where, when moving the grip means, it is not necessary to retreat a regulating means for aligning the sheets on the accumulation tray from the moving range of the grip means. Further, the grip means enable to receive the sheets under the condition of waiting for the grip means at the position of accumulating the sheet stack in the regulating means.

Further, according to the present invention, the sheet post processing apparatus of the simple mechanism and compact size is provided, where the grip means do not disturb moving of the post processing means and the aligned condition is not broken down at the sheet aligning position. The post process is possible for a short time and the grip means grip the post processed sheet stack at the sheet aligning position and enables discharge of the sheets on the discharge tray with a proper alignment. Further, the present invention provides the sheet post processing apparatus, where, by changing the moving speed of the grip portion in response to the moving position, when gripping the sheet stack, the gripping does disorder a registration of the sheet stack, when moving the sheet stack to the discharge position at high speed. Further, when discharging the sheet stack on the discharge tray, the discharging is possible to regulate at the discharge position.

According to another object of the present invention, control is performed at high speed with efficient regulation while discharging the sheet stack from an accumulation. Further, when accumulating the sheet stack onto the discharge tray, the speed is reduced to a low speed without affecting the regulation of the accumulated sheet. Further, the present invention provides the sheet post processing apparatus with an efficient sheet regulation on the discharge tray, and controls the speed of the grip portions of the sheet stack discharged onto the discharge tray at a regulation without performing complicated rotation speed of a motor.

In addition, the present invention provides the sheet post processing apparatus, where while delivering the sheet stack on the process tray to the stacker of the downstream side, even if an operator's finger or a foreign material goes into a path in a delivering course of the sheet stack, the apparatus does not go wrong or the operator is not injured. Further, with the sheet post processing apparatus of the present invention, where when accommodating the post processed sheet stack from the process tray to the stacker, even if the foreign material or the operator's finger are laid on the stacker, the operator is not injured and performance of the apparatus is not disturbed.

Further objects and advantages of the present invention will be apparent from the following description of the invention.

SUMMARY OF THE INVENTION

To accomplish the above objects, the present invention provides a sheet post processing apparatus characterized by installing an accumulation tray for aligning and accumulating the sheets delivered in succession, a post processing means for carrying out the post process such as a binding process on the sheet stack accumulated on the accumulation tray, and a grip means for gripping the post processed sheet stack and discharging onto the discharge tray.

Further, post processing means is supported along the accumulation tray reciprocally moving in transverse directions with respect to a discharge direction to the discharge tray by the grip means. The grip means has grip portions for gripping the sheet stack and a guide part for guiding the grip portion. The grip portion separates from the guide part along with a movement of the post processing means being supported along the accumulation tray reciprocally moving in transverse directions with respect to the discharge direction.

Further, the grip portions are integrally supported by a supporting member of the post process means. A drive motor is provided to enable movement in the transverse direction. The drive motor is disposed on a side plate of an apparatus frame of movably supporting the post process means. The grip portions are connected to a crank following mechanism arranged in a moving space range crossing with the delivery direction of the post process means, and is driven reciprocally back and forth of the delivery direction.

Further, the crank following mechanism is reciprocated by a crank mechanism arranged at the side plate of the apparatus frame driven by the driving motor. In addition, the grip portions are composed of two grips disposed at a predetermined space on both sides of the post process means.

Further, a structure according to the present invention to accomplish the above mentioned objects in the image forming apparatus and in the sheet post processing apparatus is described below.

According to an embodiment of the present invention, a structure having the accumulation tray with a regulating means formed with a frontage for aligning sheets delivered in succession and receiving the sheet stack heaping till the number of determined sheets is provided. The grip means is provided for gripping the sheet stack accumulated on the accumulation tray and discharge tray onto the discharge tray. The grip means is arranged to enable to grip the sheet stack at the accumulating position of the sheet stack aligned by the regulation means, and is supported to enable to reciprocate in the direction crossing with the direction of discharging of the sheet stack onto the discharge tray. The grips of the grip means open more largely than the frontage of the regulating means.

Further, as mentioned above, the sheet post processing apparatus according to the present invention is provided with the grip means for discharging the sheet stack accumulated on the accumulation tray onto the discharge tray. The grip means includes the guide portions for guiding to reciprocate the grips in the discharging direction and the crank mechanism for engaging the grips with guide paths provided in the guide portions to reciprocate the grips, where the grips successively move among respective positions of a waiting position not disturbing the accumulation of the sheet on the accumulation tray, the gripping positions of gripping the sheet stack accumulated on the accumulation tray, the discharging position on the sheet discharge tray of discharging the sheet stack, a mounting position moving down to the side of the face of the sheet discharge tray than the discharge position, and a grip releasing position at the upstream side in the discharging direction than the mounting position.

Further, according to another aspect of the present invention, a structure having the accumulation tray with the regulating means for aligning the sheets delivered in succession and the grip means for gripping the sheet stack accumulated on the accumulation tray and discharging onto the discharge tray is provided. The grip means is provided with a moving mechanism composed of the guide parts provided on the accumulation tray for guiding reciprocation of the grips in the discharging direction and the crank mechanism for engaging the grips with the guide paths provided in the guide portions to move the grips, the crank mechanism causing the grips holding the sheet stack to move to a position of gripping the sheet stack on the accumulation tray, to a position of discharging the sheet stack on an upper part of the sheet discharging tray, and to a position of mounting the sheet stack discharged on the discharging position onto the discharge tray, and the moving speed of the grips from the gripping positions to the discharging position being determined to be higher than the moving speed of the grips from the discharging position to the mounting position onto the accumulation tray.

Further, according to yet another aspect of the present invention, a structure providing a process tray for accumulating the sheets in stack from the discharging mouth, a stack means for accommodating the sheet stack disposed at the downstream side of the process tray and a sheet stack delivery means for moving the sheet stack on the process tray from the process position to the delivery position and accommodating into the stack means, the sheet stack delivery means being composed of the grips for holding the sheet stack at the end and moving to the delivery position and an actuation means for reciprocating the grips along the process tray, the process tray being provided with a guide groove for guiding the grips from the process position toward the delivery position, the grips being structured to reciprocate in moving loci in a closing loop along the guide groove, and if a foreign material goes into the guide groove or the moving loci of the grips, the actuation means (1) exhibits the grips to move or (2) retreating the grips to the process position.

BRIEF DESCRIPTION OF THE DRAWINGS

FIG. 13 shows detailed views illustrating the structure of the other directionally regulating guide plate in the guide portion according to an embodiment of the present invention;

DETAILED DESCRIPTION OF THE PREFERRED EMBODIMENTS

Detailed explanation will be made to the sheet post processing apparatus and the image forming system based on the illustrated preferred embodiments. The image forming system shown in FIG. 1 is composed of the image forming apparatus A and the sheet post processing apparatus B, and the sheet bending apparatus C which is incorporated as a unit into the sheet post processing apparatus B.

Figure 1:
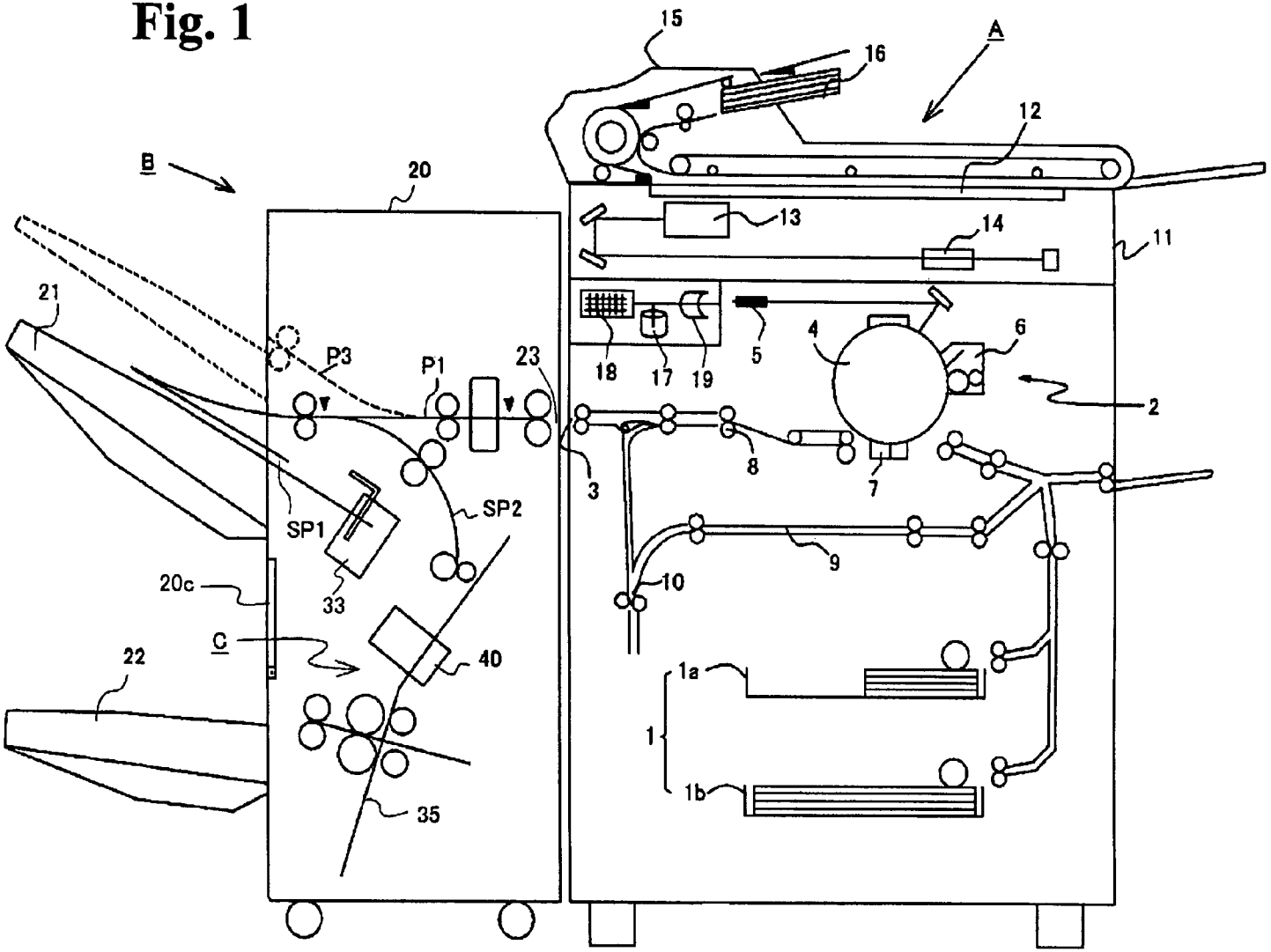
FIG. 1 shows an explanatory view of an image forming system according to the present invention.

The image forming apparatus A shown in FIG. 1 sends the sheet from a sheet feeder 1 to an image forming part 2, and discharges the sheet from a sheet outlet 3 after the sheet has been printed in the image forming part 2. The sheet feeder 1 holds the sheets of varying size in sheet feeding cassettes 1*a*, 1*b*, and separates the designated sheets one by one, and sends the separated sheets to image forming part 2. The image forming part 2 is arranged with, for example, an electrostatic drum 4, a printing head (laser photogenic organ) 5, a development unit 6, transcription charger 7 and a fixing unit 8. An electrostatic latent image is formed on the electrostatic drum 4 by the laser photogenic organ 5, a toner is adhered thereto by the development unit 6. The image is transcribed onto the sheet by the transcription charger 7, and is heat-fixed by the fixing unit 8. The image-formed sheets are then delivered in succession from the sheet outlet 3 of the image forming apparatus A. A circulation path 9 is provided for printing both sides of the sheets and reversing the sheets printed via a switchback delivery path 10, and after then again sends to the image forming part 2 for printing the insides.

An image reading apparatus 11 scans an original document set on a platen 12 by a scan unit 13, and electrically reads it by a photoelectric conversion element (not shown). The image data is, for example, digital-processed in the image process part, transferred to a data memory 19, and sends the image signal to the laser photogenic organ 5. Numeral 15 designates an original document sender which is a feeder for sending document sheets held in a stacker 16 to the platen 12.

Figure 21:
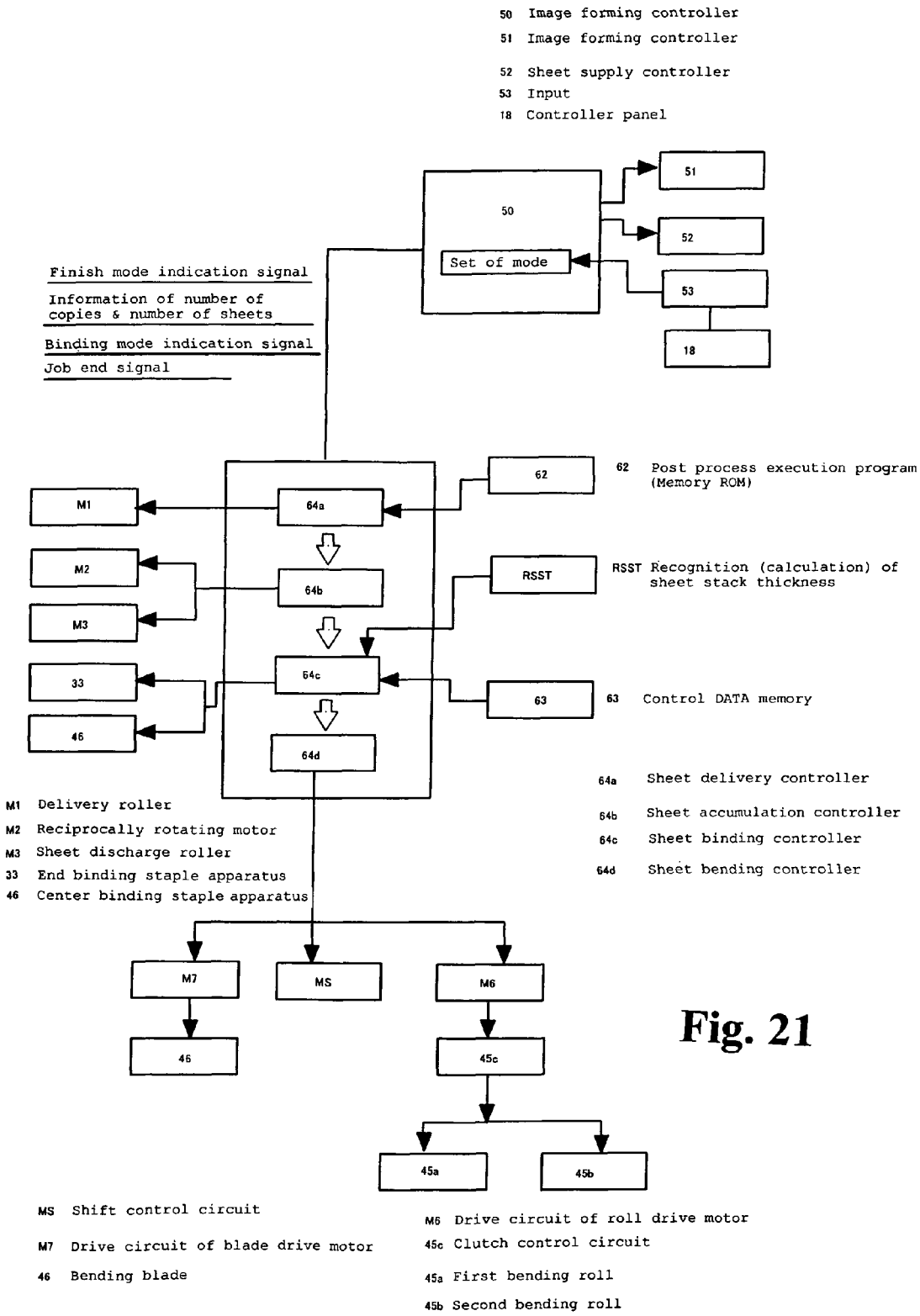
FIG. 21 illustrates a control mechanism in the image forming system according to the invention.

The image forming apparatus A of the above structure is equipped with a controller shown in FIG. 21, and a control panel 18 determines the image forming conditions of printing out conditions, for example, designation of sheet sizes, designation of color-monochrome printing conditions, that of printing number, that of one-side or both sides printing, or that of enlargement-reduction. On the other hand, in a data storage 17 of the image forming apparatus A, there are stored image data read out by the scan unit 13 or image data transferred from an outside network, and the image data is transferred from the data storage 17 to the data memory 19, and from this data memory 19, the data signals are transferred, in order, to the laser photogenic organ 5.

The control panel 18 inputs a post processing condition simultaneously with the image forming condition. The post process condition is, for example, "a print out mode", "a staple mode" or "a sheet stack bending mode". The image forming apparatus A performs image forming on the sheet in response to the image forming condition and the post processing condition.

Further, the sheet post processing apparatus B is connected to the image forming apparatus A. The sheet post processing apparatus B is so structured that the apparatus B receives the sheets formed with images from the sheet outlet 3 of the image forming apparatus A. Further, the sheet is accommodated in a first sheet outlet tray 21 (a later mentioned "print out mode"), or the sheets from the sheet outlet 3 are in stacked in set-copies justification, and after stapling, they are accommodated in the first sheet outlet tray 21 (a later mentioned "staple mode"), or after the sheets from the sheet outlet 3 are stacked in set-copies justification, they are folded in booklet and accommodated in a second sheet outlet tray 22 (a later mentioned "sheet stack bending mode").

Figure 2:
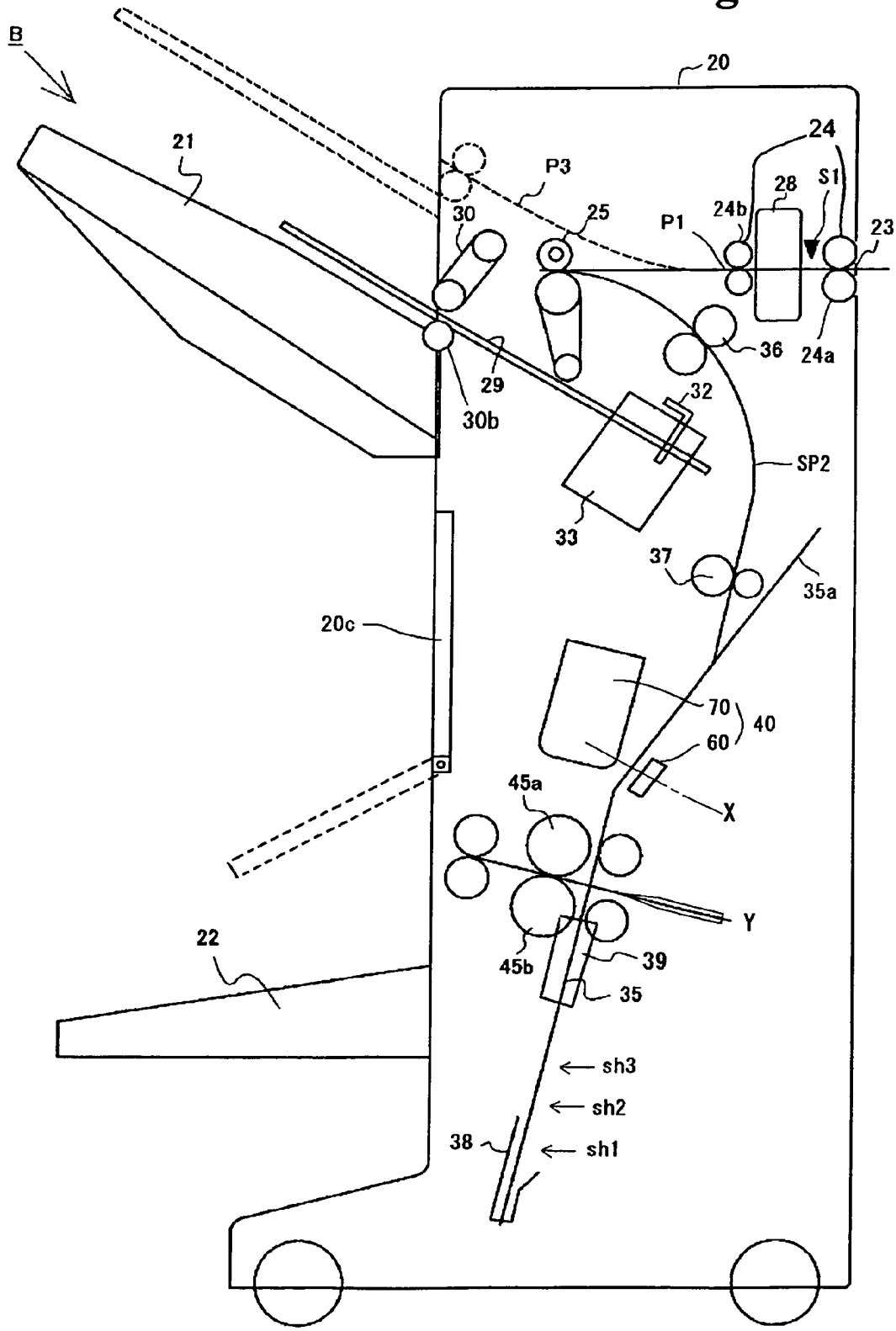
FIG. 2 shows an explanatory view of a sheet post processing apparatus according to the present invention.

Therefore, the sheet post processing apparatus B provides a first sheet discharge tray 21 and a second sheet discharge tray 22 in a casing 20 as shown in FIG. 2, and there is arranged a sheet carrying-in path P1 having a sheet inlet 23 continuing to the sheet outlet 3. The sheet carrying-in path P1 is a linear path in substantially horizontal direction with respect to the casing 20. Further, a first switchback delivery path SP1 and a second switchback delivery path SP2 are provided. The first switchback delivery path SP1 and the second switchback delivery path SP2 diverges from the sheet carrying-in path P1 and moves the sheets in a reversing direction. The first switchback path SP1 diverges to the downstream side of the path from the sheet carrying-in path P1, and the second switchback path SP2 diverges to the upstream side of the same, respectively, and both delivery paths are placed separately with respect to each other.

Further, at the downstream side of the first switchback delivery path SP1, the accumulation tray 29 is disposed and at the downstream side thereof, the first sheet discharge tray 21 is connected. The downstream side of the second switchback delivery path SP2, the accumulation guide 35 is disposed and at the downstream side thereof, the second sheet discharge tray 22 is connected.

Further, in this path structure, the sheet carrying-in path P1 is disposed with the delivery rollers 24 and the sheet discharge roller 25, and these rollers are connected to a reciprocally rotating motor M1 (not shown). The sheet carrying-in path P1 is provided with a path switching piece 27 for guiding the sheets to the second switchback delivery path SP2 and is connected to an operation means such as a solenoid. The sheet carrying-in path P1 is provided with a buffer guide 26 which temporarily stays and holds the sheets to the second switchback delivery path SP2. Between the sheet inlet 23 and the delivery rollers 24, a post process unit 28 is provided for performing post processes such as stamping (seal means) or punching (perforation means) on the sheets from the image forming apparatus A.

Figure 3:
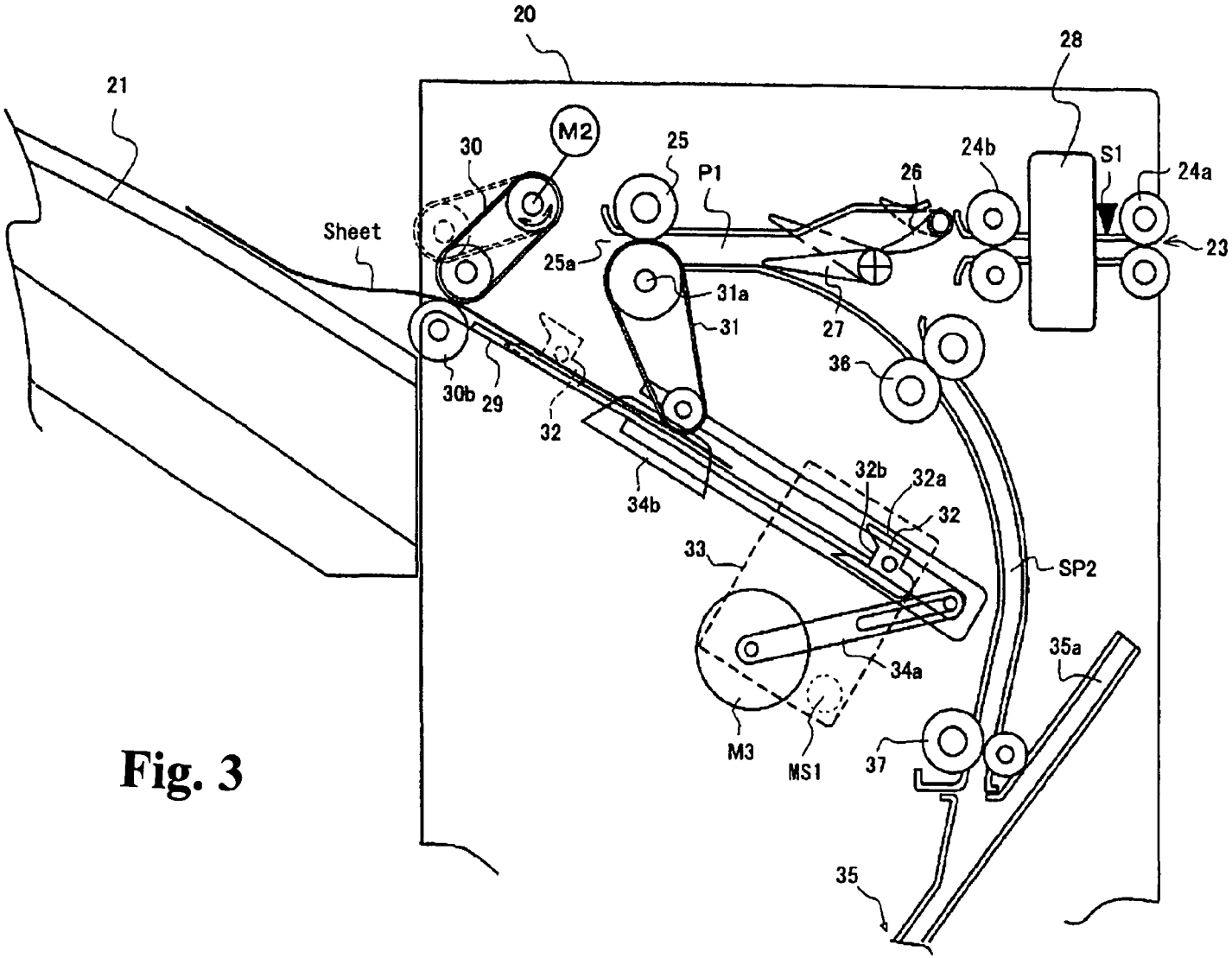
FIG. 3 shows a detailed view illustrating one part of the sheet post processing apparatus according to the present invention.

The first switchback delivery path SP1 disposed at the downstream side (the rear part of the apparatus) of the sheet carrying-in path P1, preferably has a structure as described below. As shown in FIG. 3, the sheet carrying-in path P1 is furnished, at the end of the exit, with a delivery roller 25 and a sheet outlet 25*a*, and at a lower part via a difference in level from the sheet outlet 25*a*, the accumulation tray 29 is provided which has a tray for accumulating and supporting the sheets from the sheet outlet 25*a*.

Further, above the accumulation tray 29, a reciprocally rotating roller 30 vertically moves between a position contacting the sheets on the tray and a waiting position (a position of dotted line in FIG. 3) separating from sheets. The reciprocally rotating roller 30 is controlled to rotate in a clockwise direction (in FIG. 3) when a reciprocally rotating motor M2 is connected thereto and the sheets enter onto the accumulation tray 29. After the back ends of the sheet enter on the tray, the roller 30 rotates in a counterclockwise direction. Accordingly, the first switchback delivery path SP1 is formed on the accumulation tray 29. A loop belt 31 and a sheet discharge roller 25 and one end of a pulley side are pressed and axially supported turnably such that a front end of the pulley side suspends onto the accumulation tray 29. A follower roller 30*b* engages the reciprocally rotating roller 30 and is provided on the accumulation tray 29.

Further, by the above structure, the sheets from the sheet outlet 25*a* enter onto the accumulation tray 29, and are moved toward the first sheet outlet tray 21 by the reciprocally rotating roller 30, and after the back ends of the sheet enter on the tray from the sheet outlet 25*a*, if the reciprocally rotating roller 30 is rotated (in the counterclockwise direction), the sheets on the tray are moved in a reverse direction to the discharge direction. At this time, the loop belt 31 cooperates with the reciprocally rotating roller 30 to switchback deliver the rear ends of the sheets along the accumulation tray 29.

At the rear end in the discharging direction of the accumulation tray 29, a back end regulation member (an alignment stopper) 32 for regulating the position of the sheet back end and the staple apparatus ST1 are provided. The staple apparatus ST1 has a back end binding stapler for stapling one portion or plural portions of the back ends of the sheet staple accumulated on the tray.

Further, the grip means (also called as "gripper means" hereafter) G10 (FIG. 5) reciprocally move in the discharging direction along the accumulation tray 29 for delivering the sheet stack stapled by the accumulation tray 29 to the first sheet discharging tray 21 placed at the downstream side of the accumulation tray 29. The gripper means G10 have gripper members (grip portions) G11 for gripping the sheet stack and are movably located on a right and left along a later mentioned guide groove formed in the accumulation tray 29. A turning axial arm G20 reciprocates the gripper member G11, and is connected to a sheet discharge motor M3.

The accumulation tray 29 is provided with a side alignment plate (aligning side plate) 34 for aligning the sheets on the tray in the width direction, and the side alignment plate 34 is composed of a pair (right and left) of alignment plates (back and forth in FIG. 3) to approach to or separate from the center of the sheet, and connected to an alignment motor M4 (not shown).

The above structured first switchback delivery path SP1 carries out, during "stapling mode", a set-copies justification on the accumulation tray 29 in regard to the sheets from the sheet outlet 25*a*, and this sheet stack is subjected to stapling at one or plural parts of the back end by means of the end binding staple apparatus ST1. At a time of "print out mode", the sheets from the sheet outlet 25*a* along the accumulation tray 29 is not switchback delivered, but delivered between the reciprocally rotating delivery rollers 30 and the following rollers 30*b* to the first sheet outlet tray 21. The shown apparatus is characterized in that the sheets to be stapled are bridge-supported by the accumulation tray 29 and the first sheet outlet tray 21, thereby to make the apparatus compact.

At the time of "print out mode", a new divergent point is provided on the way of the sheet carrying-in path P1, it is also sufficient to provide the sheet outlet tray, for discharging the sheets during the "print out mode", above the first sheet outlet tray 21 for distinguishing from the sheets discharged by "staple mode" and stocking the sheets discharged during the "print out mode".

Figure 4:
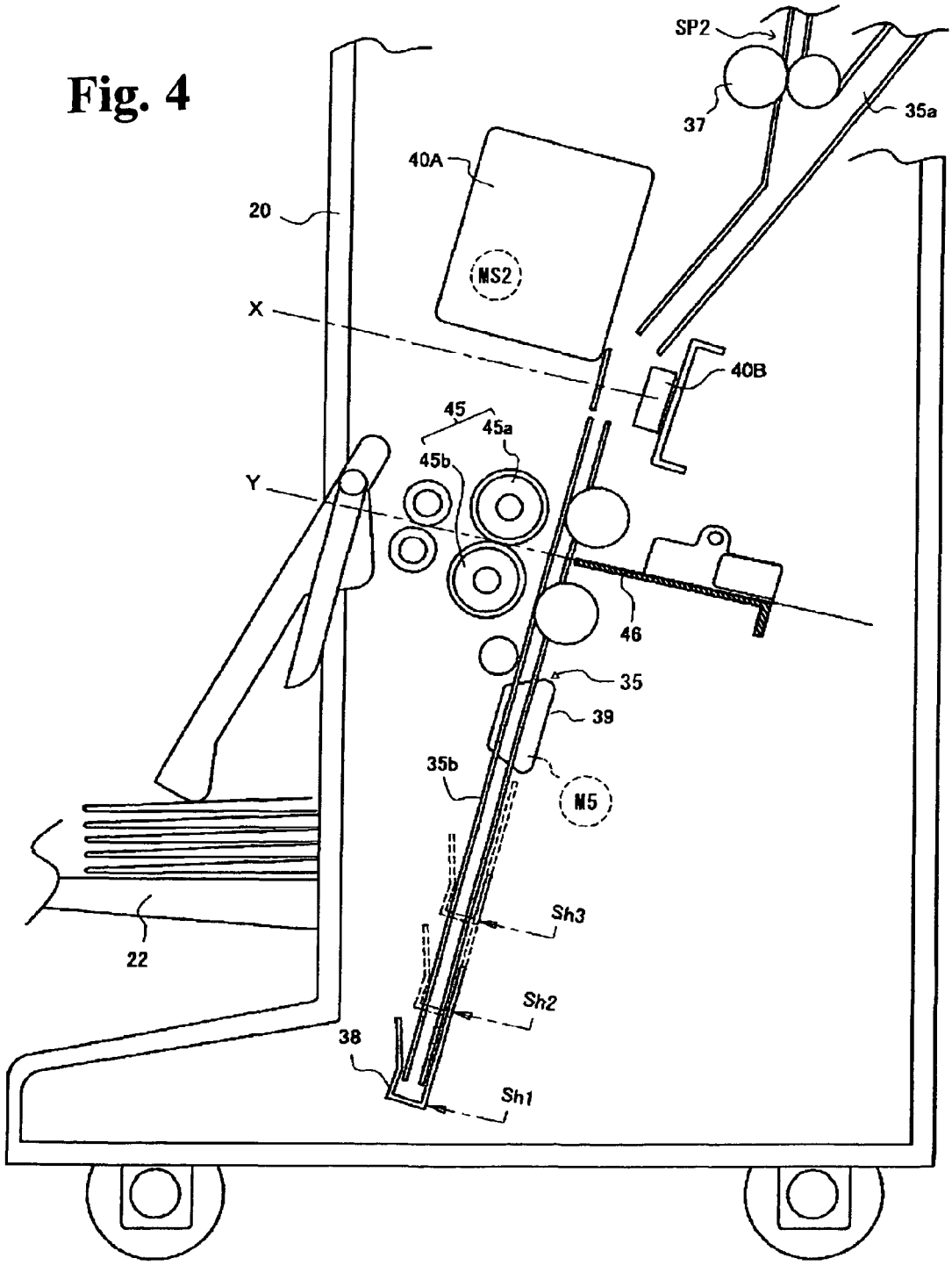
FIG. 4 shows a detailed view of a sheet bending apparatus in the sheet post processing apparatus according to the present invention.

Further, the second switchback delivery path SP2 is diverged from the sheet carrying-in path P1. With respect to the second switchback delivery path (the sheet process path) SP2, as shown in FIG. 4, an accumulation guide (a sheet holding means) 35 is disposed in a substantially vertical direction to the casing 20. The accumulation guide 35 is composed of a sheet entry path 35*a*, a curved guide part 35*b*, a switchback entry path 35*c* and an exit guide part 35*d*. The sheet entry path 35*a* is provided at the path exit part of the second switchback delivery path SP2, and by forming a stepwise difference from the entry path, the curved guide part 35*b* is provided. The switchback entry path 35*c* is continued to the rear side of the curved guide part 35*b*.

The sheets sent from the sheet entry path 35*a* composed of the second switchback delivery path SP2 to the curved guide part 35*b* are successively accumulated upward. Therefore, the sheets accumulated on the guide part are retreated at the back ends to the switchback entry path 35*c* in order to accumulate the sheets sent from the sheet entry path 35*a* on the uppermost sheet of the curved guide part 35*b*.

Further, explanation will be made in detail with respect to the curved guide part 35*b*, a center bind staple apparatus ST2 arranged thereto and a bend roll means 45. At first, the curved guide part 35*b* is composed of the sheet hold means arranged obliquely for accumulating the sheets sent from the second switchback delivery path SP2 on a bending position Y, and the sheet hold means is set with a binding position X and the bending position Y. The binding position X is arranged with a later mentioned staple means (the center bind staple apparatus), and the bending position Y is arranged with the bend roll means 45. In particular, the illustrated curved guide part 35*b* is composed of a curved or bent guide plate such that the sheet stack supported by the curved guide part 35*b* projects toward the side of the bend roll means 45 at the bending position Y and bends backward. Accordingly, the sheets from the sheet carrying-in path P1 are accumulated successively on the curved guide part 35*b*, and the sheet stack projects toward the side of the bend roll means 45 and bends backward.

The bending position Y of the curved guide part 35*b* is continued to an exit guide part 35*d* which is composed of opposite guide pieces strangulating to gradually bend the sheet stack. In short, the curved guide part 35*b* is formed to enable to accommodate the sheet having a maximum size for successively piling to accumulate the sheets from the sheet inlet 23 upward. The curved guide part 35*b* is structured to bend or to be in a bent shape as projecting to the side disposing a later mentioned center bind staple apparatus ST2 and a bend roll means 45. The above mentioned switchback entry path 35*c* overlaps the front ends of the carrying-in (following) sheets sent from the sheet entry path 35*a* and the rear ends of the accumulated (preceding) sheets supported on the curved guide part 35*b* for securing the page order of the sheets to be accumulated. The accumulation guide 35 has a front end regulation means 38 at the downstream side of the guide.

Next, referring to FIGS. 5-13, explanation will be made to an end bind structure which performs the stapling process on the end part of the sheet stack by the end bind staple apparatus ST1, grips the sheet stack having passed the stapling process with the gripper means G10 and discharges the sheets from the accumulation tray 29 onto the first sheet discharge tray 21.

Figure 5:
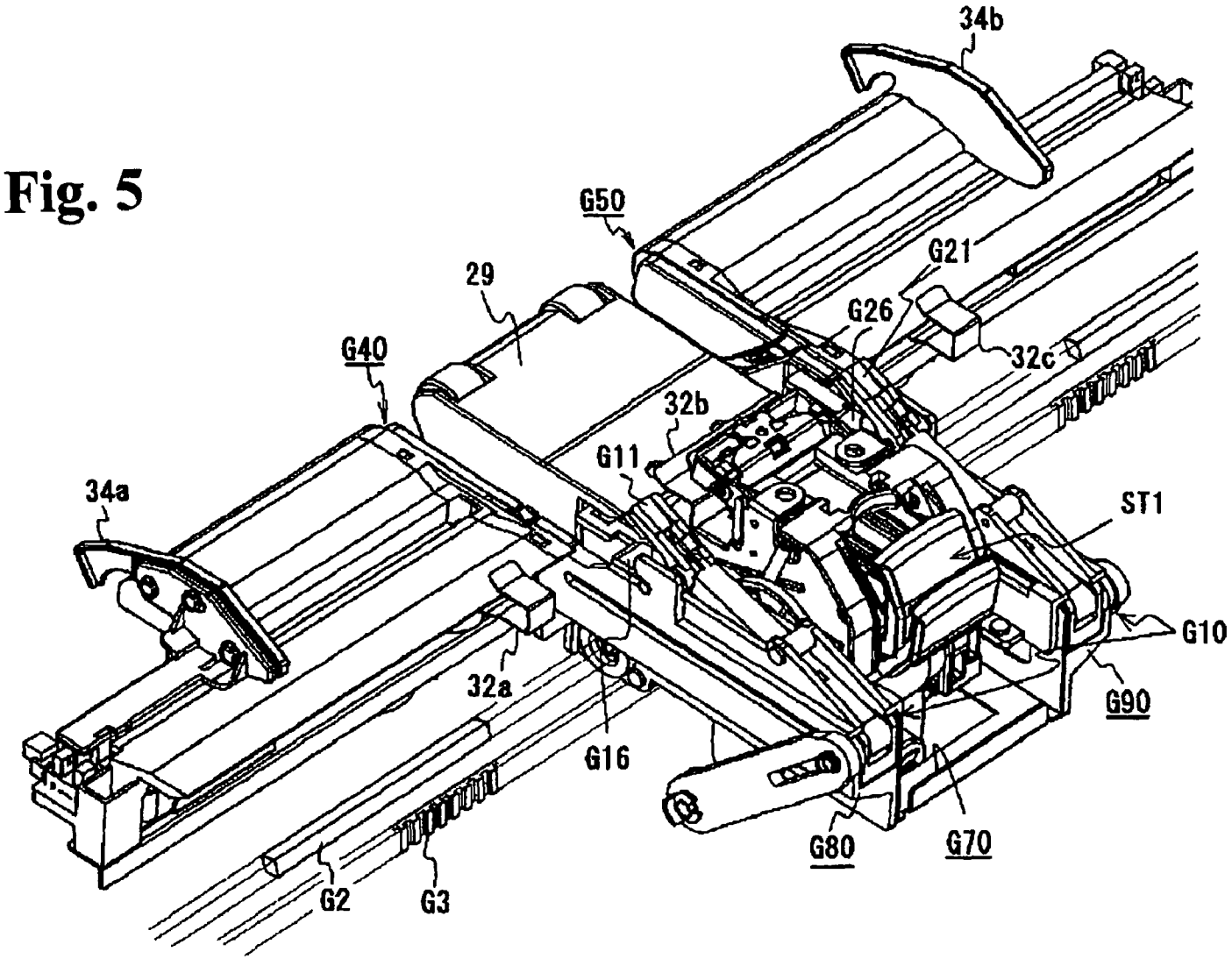
FIG. 5 shows a perspective view of an elementary part of the sheet post processing apparatus.

At first, the overall structure of the sheet end bind mechanism will be explained based on FIG. 5. The accumulation tray 29 fixedly supports the back end regulation member 32 (32*a*, 32*b*, 32*c*) for receiving and aligning the back ends of the sheets brought from the copying apparatus, and supports a side alignment plate 34 (34*a*, 34*b*) for positioning the brought sheets turnably right and left on the standard of the tray center position. By determining the standard, it is possible to fix one and turn the other.

The staple apparatus ST1 for performing the staple process on the end of the sheet stack and the supporter G70 for mounting the gripper means G10 are provided with a rotation shaft G2 square in cross section and a timing belt G3 of tooth form in cross section, the rotating shaft G2 being rotated by a rotation drive motor (not shown) provided on the apparatus frame supporting movably the supporter G70 for reciprocating the grip parts (G11, G16) of the gripper means G10 in the sheet stack discharging direction along the sheet accumulation face of the accumulation tray 29, and the timing belt G3 being moved by a drive source (not shown) for reciprocating the supporter G70 in a direction almost transverse with the sheet stack discharging direction along the accumulation tray 29.

Figure 6:
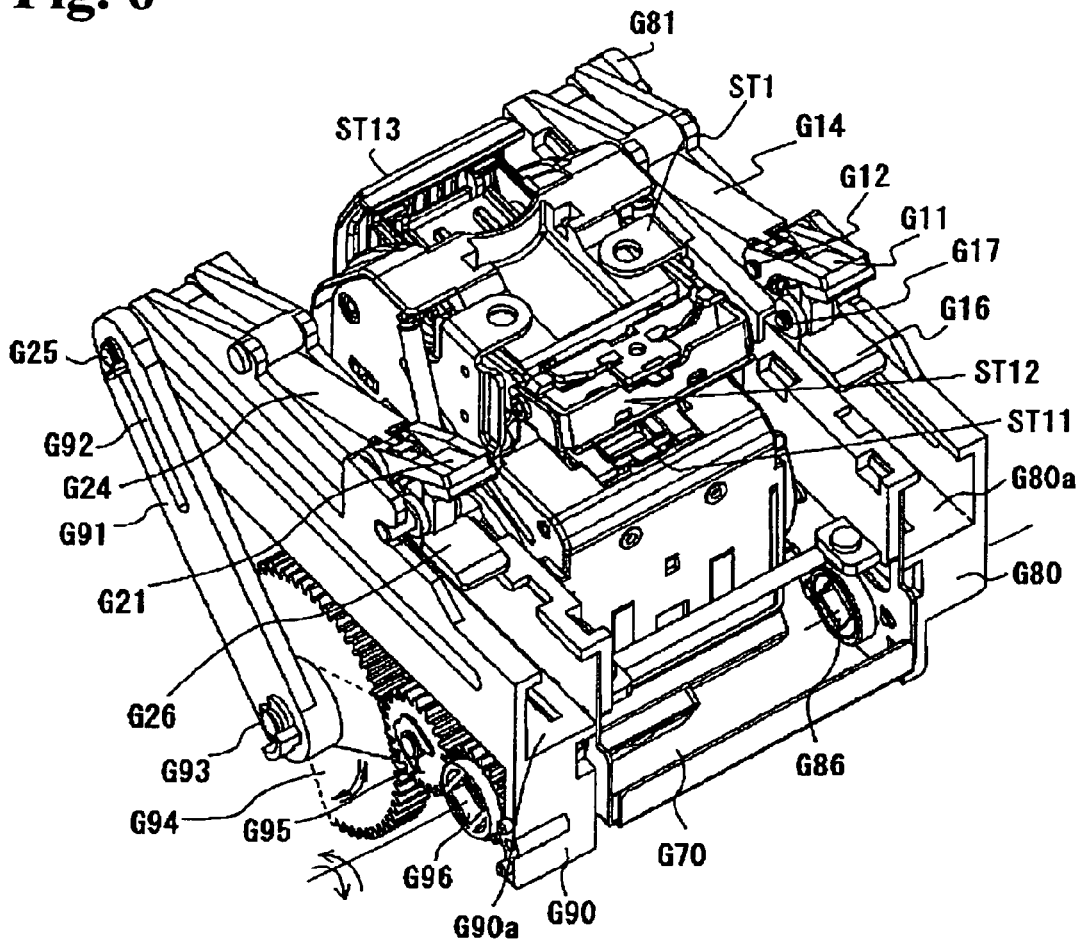
FIG. 6 shows a detailed view of a unified structure of the post processing means and the grip means in the sheet post processing apparatus.
Figure 7:
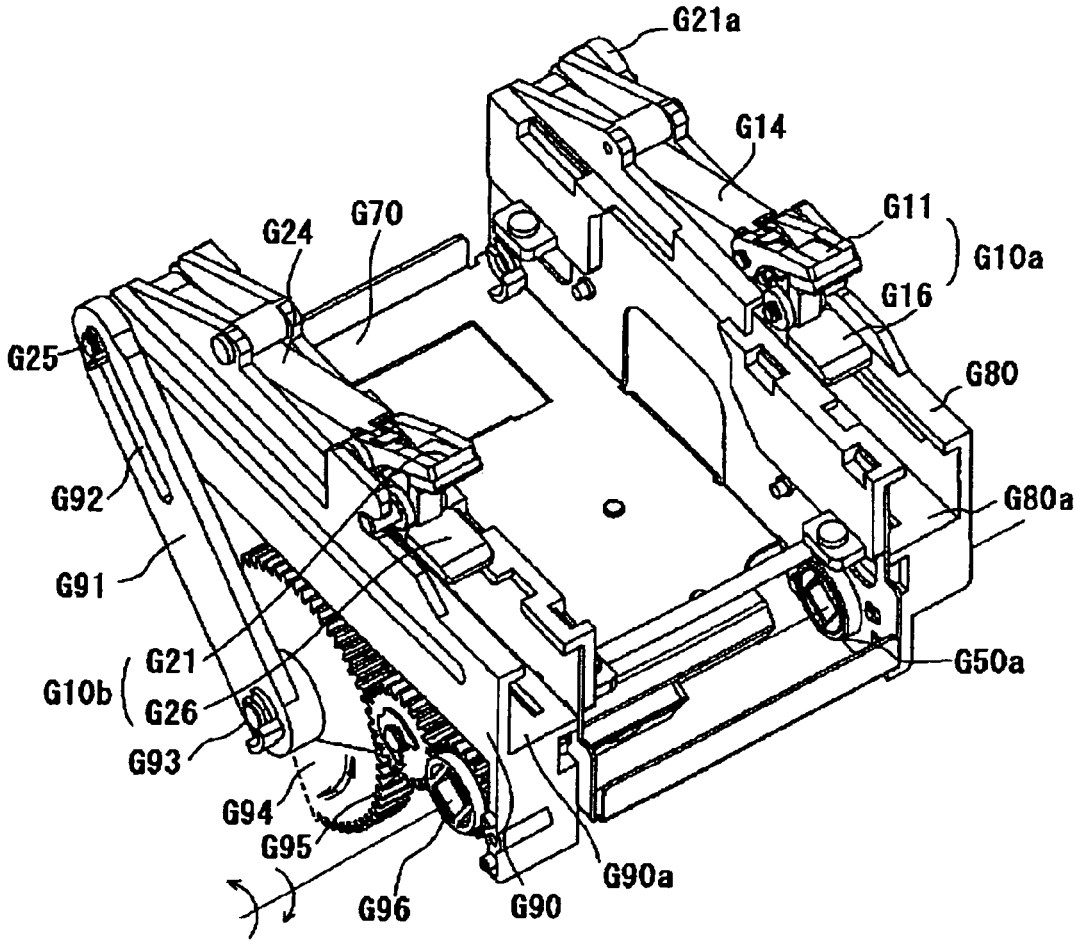
FIG. 7 shows a detailed view removing the post processing means.

With reference to FIGS. 6 and 7, explanation will be made in detail regarding the structures of the supporter 70 and the gripper means G10. FIG. 6 shows a condition of composing a moving unit mounting the staple apparatus ST1 between a right and left pair of grip parts (G11, G16) (G21, G26) turnably supported to supporter G70, and FIG. 7 shows a condition taking off staple apparatus ST1 from the moving unit. Referring to FIG. 7, support frames G80, G90 for attaching the staple apparatus ST1 with a distance corresponding to the width of the staple apparatus ST1 in the right and left direction of the supporter G70 are provided, and there are groove parts G80*a*, G90*a* for guiding movement of the grip parts (G11, G16) (G21, G26) by using the space ranges of the groove parts G80*a*, G90*a*, a first gear G96 formed with an axial hole square in cross section for passing the above explained rotating shaft G2 square in cross section at the outside face of the supporting frame G90 and receiving transmission of driving, a second gear G95 receiving rotation of the first gear, a fan shaped gear G94 at a final step receiving rotation of the second gear G95 and rotating and turning, and a reciprocally turning lever G91 reciprocally turning by rotation of the fan shaped gear G94. Also in the supporting frame G80, there are installed a first gear G86, a second gear G85, a fan shaped gear G84, and a reciprocally turning lever G81 formed with a slit G82 fitted with the reciprocally turning axis of a later mentioned grip G10 around a rotating axis G83 being rotating centre of the fan shaped gear G84.

Figure 8:
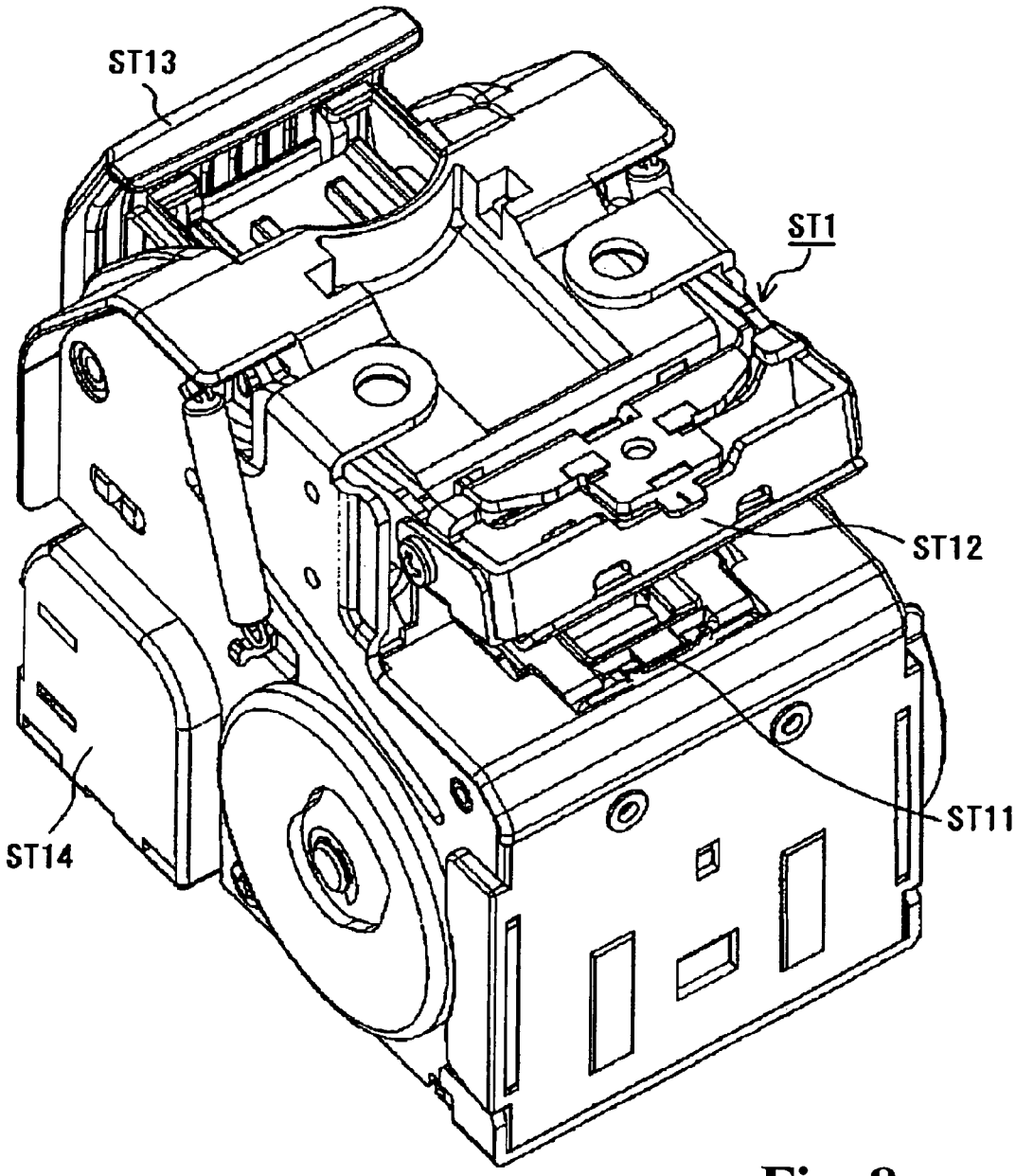
FIG. 8 shows a detailed view illustrating the post processing means.

Further, detailed explanation will be made with regards to a structure of the staple apparatus ST1 based on FIG. 8. The staple apparatus ST1 is roughly composed of a head ST11 of driving staplers into the sheet stack, an anvil ST12 of bending needle points of the staplers drove in and passing through the sheet stack, a cartridge ST13 of supplying and filling up the staplers to the head ST11, and a drive part ST14 of housing the drive motor driving the anvil ST12.

The structure of the gripper means G10 will be explained in detail referring to FIG. 9. The gripper means G10 is composed of grip parts G11 and G20 being separate and a guide part G40. When the supporter G70 moves right and left, the grip part G11 separates from the guide part G40 and becomes movable. In the drawing, K0 (K1 to K4) is a crank mechanism, and will be later explained in detail.

The grip parts G11 to G20 are composed of an upper grip part G11 for gripping the sheet stack, a turning axis G12 for turnably supporting the upper grip part G11, an opening lever G13 which contacts an engaging member (not shown) at a return position (home position) and rotates in a counter clockwise direction in order to overcome an urging force of a spring means (not shown) always urging in a direction of the upper grip part G11 gripping the sheet stack at the home position, an arm lever G14 for moving the upper grip part G11 gripping the sheet stack to a discharging position of the sheet discharge tray 21, a connection axis G15 for engaging a slit G82 of the reciprocally turning lever G81 by moving the arm lever G14 and a lower grip part G16, a turning axis G17 for turnably supporting the lower grip part G16, a turning axis G17 for rotating the lower grip part G16 to maintain a posture supporting the under surface of the sheet stack in parallel with the sheet mounting face of the accumulation tray 29 even if the lower grip part G16 moves, an arm lever G18 for moving the lower grip part G16 until the discharging position of the sheet discharge tray 21, a turning axis arm G20 disposed at a place of forming an almost rectangular shape in addition to the turning axis G12, the connection axis C15 and the turning axis G17 for the arm lever G18 and an arm lever G14 to adjust the posture of the lower grip part G16, and the turning lever G35 for forcibly rotating the grip parts G11 to G20 around the center of the turning axis arm G20.

On the turning axis G12, a release lever G19 is provided which engages an oblique face of a guide part G40 to be explained with reference to FIG. 17 (later mentioned), and reduces the urging force of a spring means (not shown) always urging the upper grip part G11 going back to a returning position via a return guide G44 in a direction of gripping the sheet stack and releasing a nip force in order to make it easy for releasing the sheet stack.

Further, similar to the opening conditions of the head ST11 and the anvil ST12 of the stapler apparatus ST1, when the grip parts G11 to G20 are present at the return positions (home positions), the connection with a later mentioned guide part G40 is released, and at the same time, the opening width of the upper grip part G11 and the lower grip part G16 is maintained to be larger than the sheet accumulation width of the sheet back end regulating member 32 (32*a*, 32*b*, 32*c*) installed on the accumulation tray 29 (refer to FIG. 5), and the sheet stack is mounted together with the stapler apparatus ST1 and moved when the supporter G70 moves, irrespective of presence or absence of the sheet back-end regulating member 32 (32*a*, 32*b*, 32*c*).

The guide part G40 is provided in each of grooves formed in the accumulation tray 29 at two places with an appropriate space, and substantially the same in function, though the shapes are more or less different depending on the places. Herein, to explain the guide part 40, is the guide part 40 comprises a reciprocal guide G41 for supporting the turning axis G12 along with the reciprocation of the above explained grip parts G11 to G20 and moving to the side of the accumulation tray 29 (refer to FIG. 5) along the accumulation face of the sheets turning axis G12, a lowering guide G42 for guiding the turning axis G12 to a lower sheet discharging position under a condition of discharging the sheet stack above the sheet discharging position of the accumulation tray 29, a release guide G43 having an engaging function with the release lever G19 for lightening a nip pressure turning the release lever G19 for lightening the nip pressure of the sheet stack of the upper grip part G11 at the sheet discharge position and a function making easy taking-in for returning the turning axis G12, a reciprocal guide G44 of guiding movement of the turning axis G12 at the reciprocation position, and a later mentioned one-direction regulating guide plate G60.

The one-direction regulating guide plate G60 enables the turning axis G12 to return on the way of the reciprocal guide G41 returning from the reciprocal guide G44 to the returning position in order to display a compact property of the apparatus, guides the reciprocal guide G41, thereby not to drop downward while cutting out the reciprocal guide G41, and making it easy to returns to the reciprocal guide G41.

By providing the guide parts G40, G50 to the accumulation tray 29, and retreating downward than the accumulating face of the accumulation tray when returning the grip parts G11 to G20 and G30, the sheets are not stopped from discharging from the image forming apparatus A during reciprocation but are received onto the accumulation tray 29.

Figure 10:
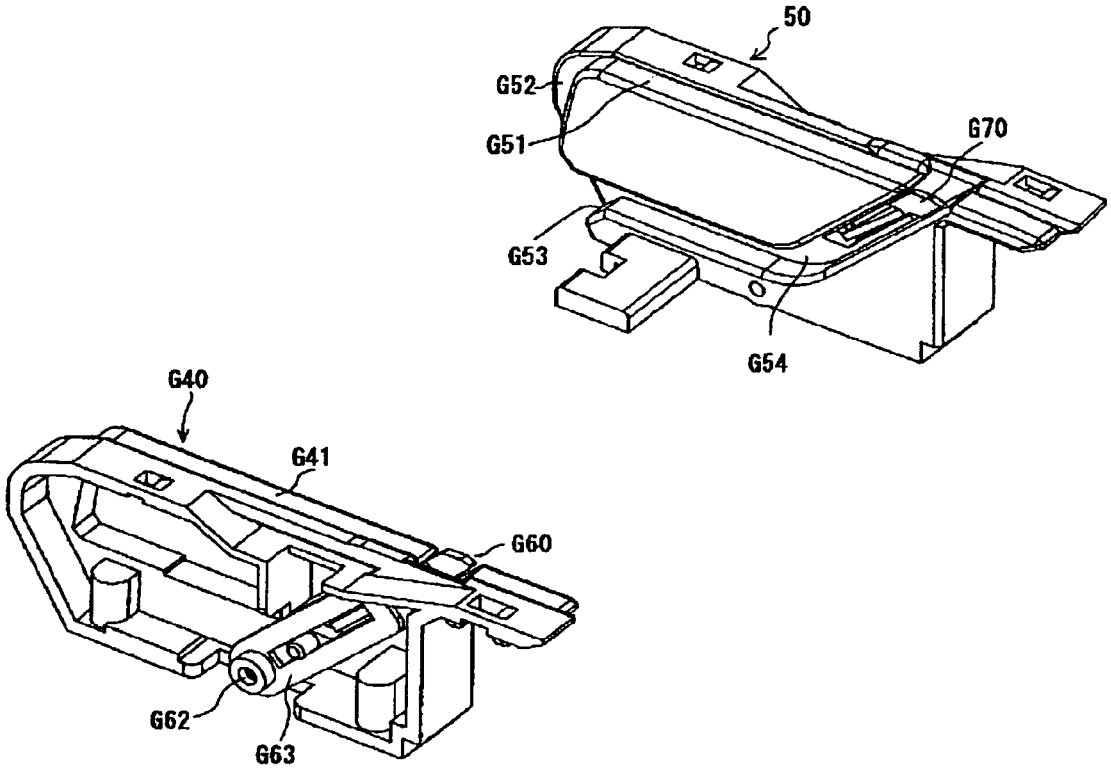
FIG. 10 shows a detailed view illustrating the structure of the guide portion illustrated in FIG. 9.
Figure 12:
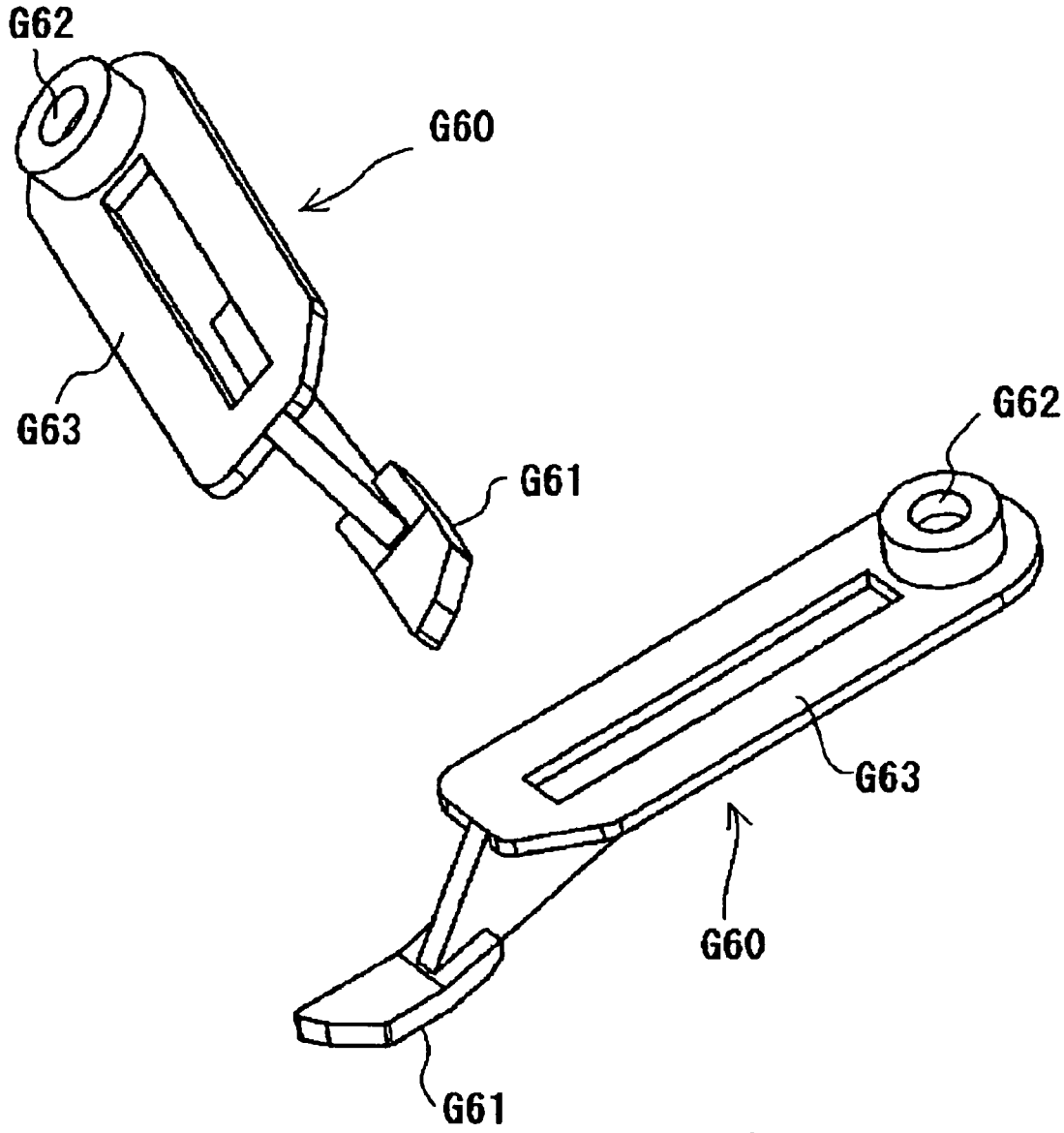
FIG. 12 shows detailed views illustrating the structure of one directionally regulating guide plate in the guide portion.

The one-direction regulation guide plate G60 is, as shown in FIG. 10, attached to the guide part G40, and as shown in FIG. 12, a resin-formed with a fulcrum G62 supported by the guide part G40, a contacting oblique face G61 contacted to the turning axis G12 and displacing in along with the movement of the turning axis, and an arm G63 elastically formed when returning the turning axis G12 and displacing at the arm G63 are provided.

Figure 11:
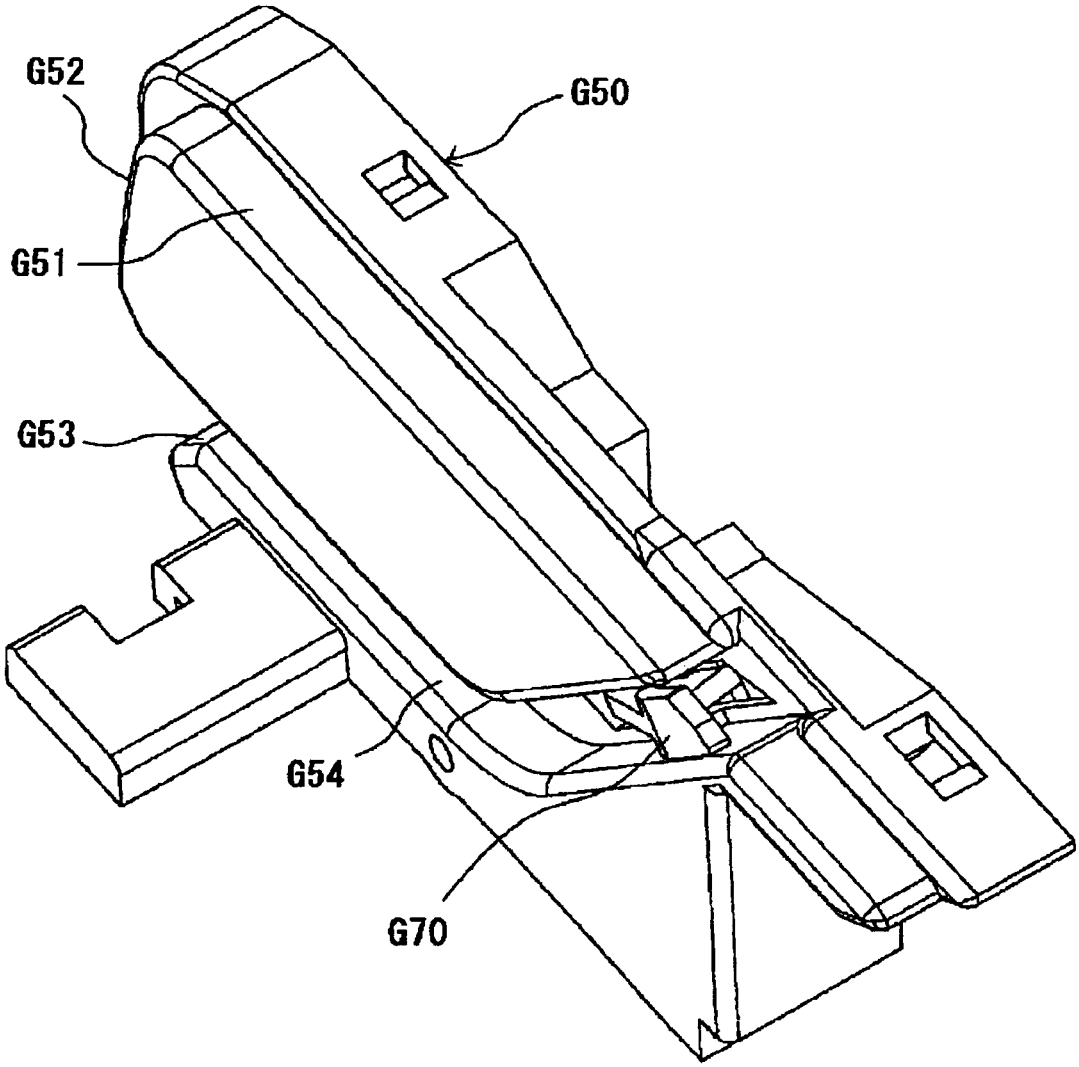
FIG. 11 shows an exploded view of one side of the guide portion.

The other one-direction regulating guide plate G70 is, as shown in FIGS. 10 and 11, attached to the guide part G50, and as shown in FIG. 13, resin-formed with a fulcrum G72 supported by the guide part G50, a contacting oblique face G71 contacted to the turning axis G22 (similarly to the turning axis G12, and corresponding to one of the right and left symmetry with omitting a detailed illustration) and displacing in along with the movement of the turning axis, and an arm G73 elastically formed when returning the turning axis G22 and displacing at the arm G71 are provided.

Further, the present embodiment has the gripper means at two positions, but taking the gripping ability or the delivery precision into consideration, one position or three or more positions will be sufficient, and in case of providing the two gripper means, the gripping is possible at an optimum position of the sheet balance, and further, the connection positions with the three guide parts are selectively switched to move the gripper means to the connection positions, and the sheet stack can be offset appropriately by discharging the sheet stack to the discharge tray.

Figure 14:
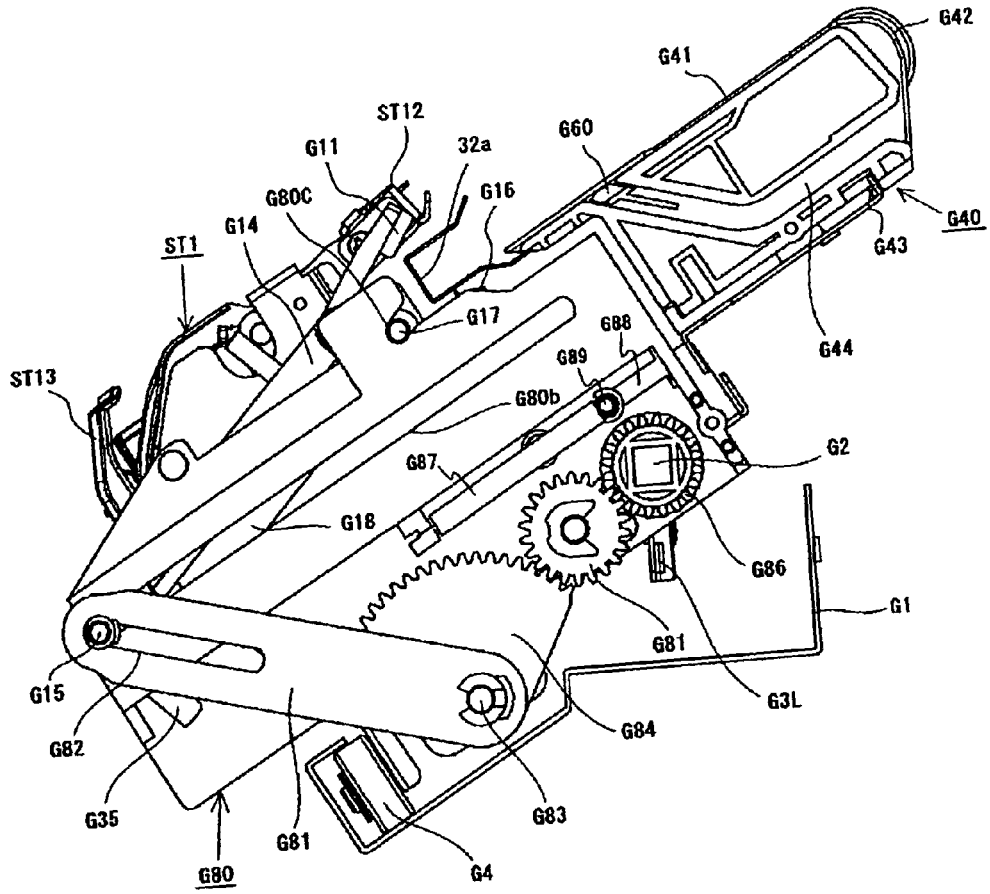
FIG. 14 shows a side view of the crank mechanism and the grip in the sheet post processing apparatus in the first waiting position according to an embodiment of the present invention.

The sheet end bind actuation will be explained in detail with reference to FIGS. 5, 6 and 14. At first, when there is the supporter G70 mounting the staple apparatus ST1 and the gripper means G10 at the position shown in FIG. 5, considering that, when "Stapling mode" and "End closing mode" is selected from the control panel 18 (refer to FIG. 1) of the image forming apparatus A, and further under a condition where, as shown in FIG. 14, the staple apparatus ST1 and the gripper means G10 more open than the accumulation width of the sheet back-end regulating member 32 (32*a*, 32*b*, 32*c*), the sheets are aligned and accumulated by the sheet back-end regulating member 32. Concurrently, in FIG. 5, a timing belt G3 moving the supporter G70 appropriately left and right during accumulation of the sheets moves the supporter G70 to the stapling position. At the staple position, the stapling process is performed so that the anvil ST12 is turnably lowered, and the sheet stack is nipped at the stapling position with the head ST11 and the anvil ST12, and under this condition, the head ST11 drives the staplers into the sheet stack, and the anvil is driven into the sheet stack to bend the needle points of the staplers passing the sheet stack.

The stapling process is performed at one position of a corner of the sheet staple and at two positions separating with equal distances about a center in sheet width, or by moving the staple apparatus ST1 to appropriate plural positions.

The gripping actuation will be explained with reference to FIGS. 5 and 14 to 20. Explanation will start with a structure of arranging guide parts G40, G50 at the two positions separating with equal distances from the center in sheet width. At first, the above explained stapling process is performed. In the case where the supporter G70 mounting the staple apparatus ST1 and the gripper means G10 are positioned at the position shown in FIG. 5, the rotation shaft G2 rectangular in cross section rotates in the clockwise direction by a drive motor (not shown). The first gear G86 follows by receiving this rotation, and rotates in the clockwise direction. A second gear G85 being in mesh with the first gear G86 rotates in a counter clockwise direction, so that the fan shaped gear G84 rotates in the clockwise direction. A reciprocally turning lever G81 integral with the fan shaped gear G84 rotates in the clockwise direction.

Figure 15:
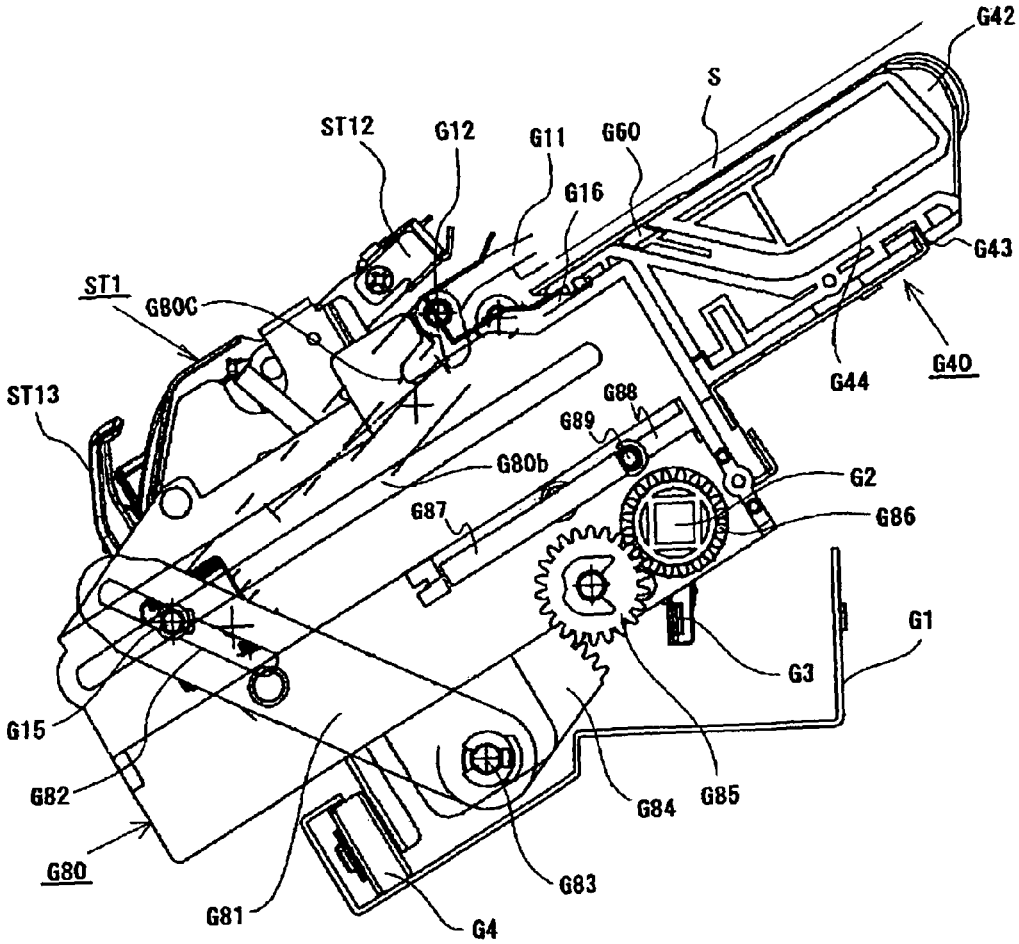
FIG. 15 illustrates a second gripping position of the crank mechanism and the grip according to an embodiment of the present invention.

Further, after receiving the clockwise rotation of the reciprocally turning lever G81, as shown in FIG. 15, the connection axis G15 of the grip parts G11 to G20 fitted in the slit G82 of the reciprocally turning lever G81 moves, and the turning axis G12 separates from the groove of a support frame G80 along with the movement of the connection axis G15, whereby the upper grip part G11 grips the sheet stack together with the lower grip part G16. At this time, by gripping the sheet stack while pushing the side end of the sheet stack with the standing face of the lower grip part G16, the sheet stack is neatly gripped without sliding the uppermost sheet of the sheet stack.

Figure 16:
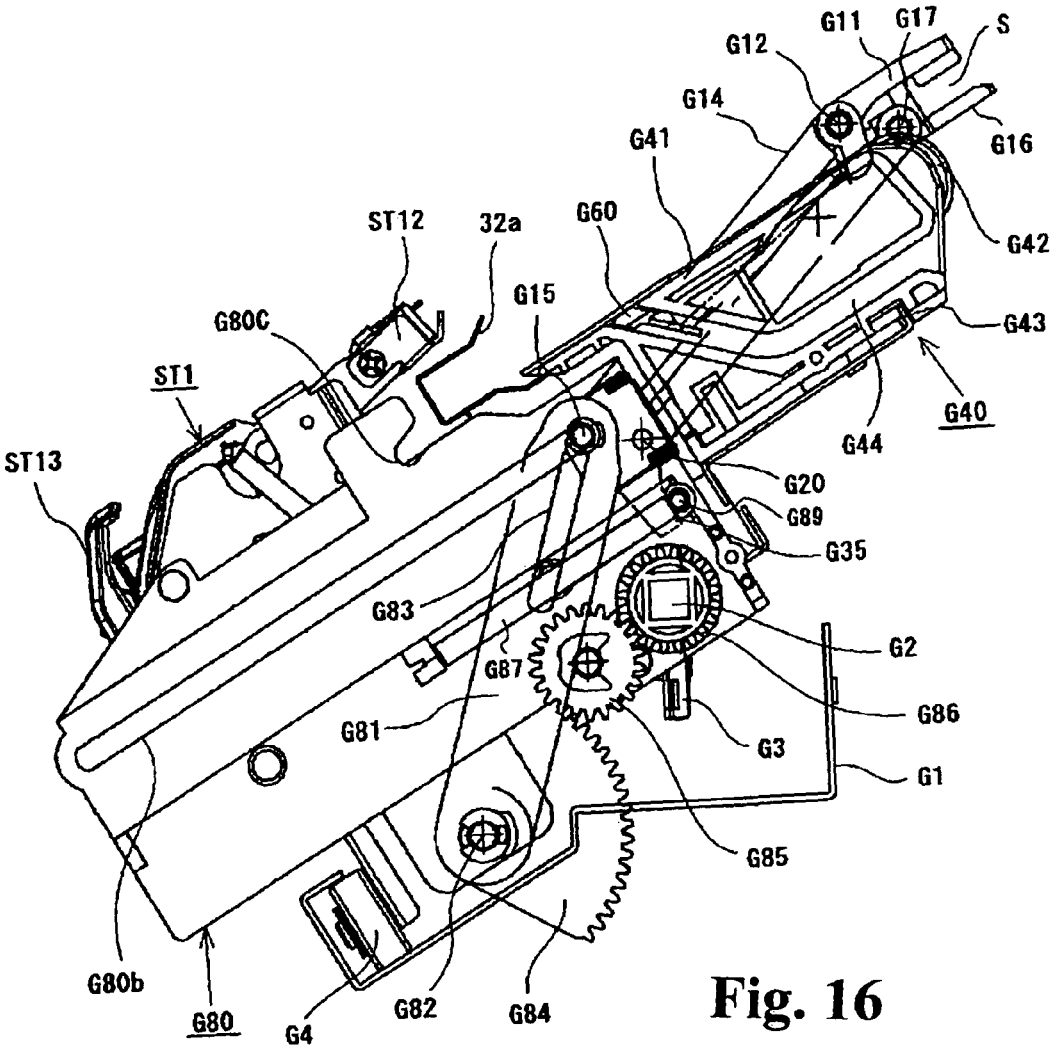
FIG. 16 illustrates a third discharging position of the crank mechanism and the grip according to an embodiment of the present invention.

When the reciprocally turning lever G81 rotates until the position shown in FIG. 16, the sheet stack is discharged under the condition that the upper grip part G11 and the lower grip part G16 project above the sheet outlet. Under this condition, the turning lever G35 of the grip parts G11 to G20 contacts an urging axis G89 movably supported along a slit G88 always urged, left-downward in FIG. 16, by a tension spring G87 to the side wall of the support frame G80, and is forcibly rotated in the clockwise direction, so that the grip parts G11 to G20 are forcibly rotated around the center of the turning axis arm G20.

Figure 17:
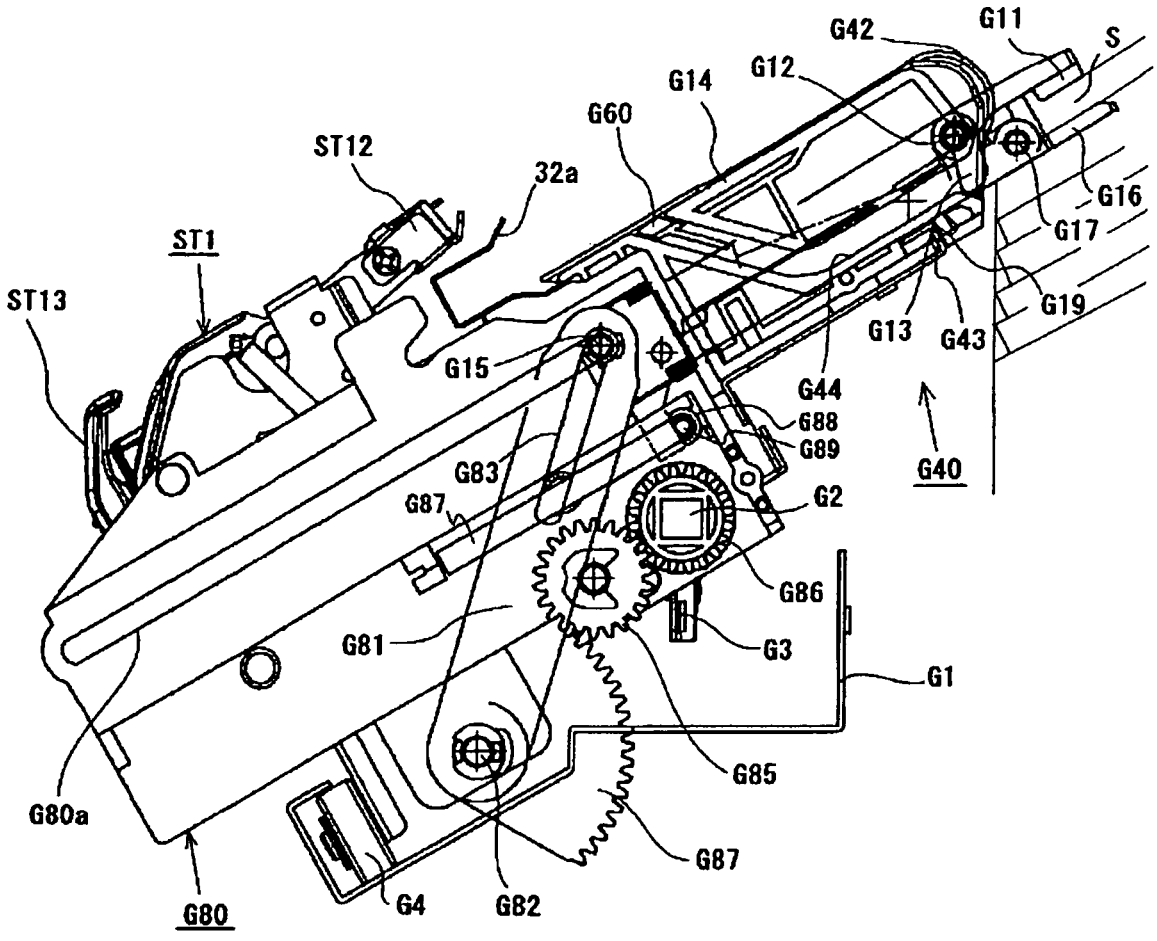
FIG. 17 illustrate a fourth accumulating position of the crank mechanism and the grip according to an embodiment of the present invention.

By the forcible rotation, as shown in FIG. 17, the turning axis G17 of the grip parts G11 to G20 moves along the lowering guide G42 of the guide part G40, the upper grip part G11 and the lower grip part G16 grip the sheet stack, move the sheet stack in the vicinity of the faces of the discharged sheets of the accumulation tray 29, and pile on the accumulation face. At the same time, the release lever G19 of the grip parts G11 to G20 is rotated in the counterclockwise direction by the end face of the release guide G43 to lighten the gripping force of the sheet stack.

Figure 9:
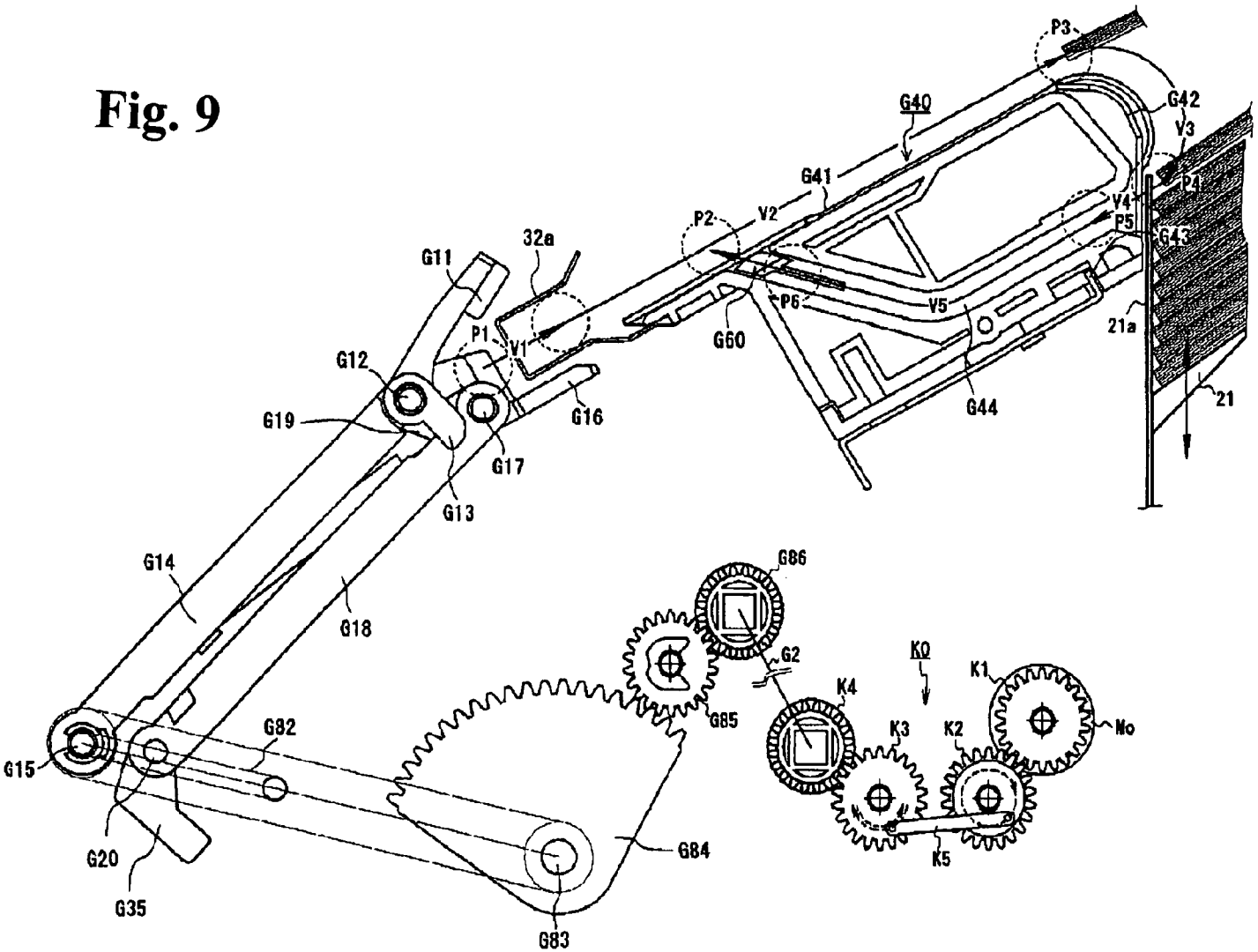
FIG. 9 shows a detailed view of the structures of the grip and the guide portion in the sheet post processing apparatus according to the present invention.
Figure 18:
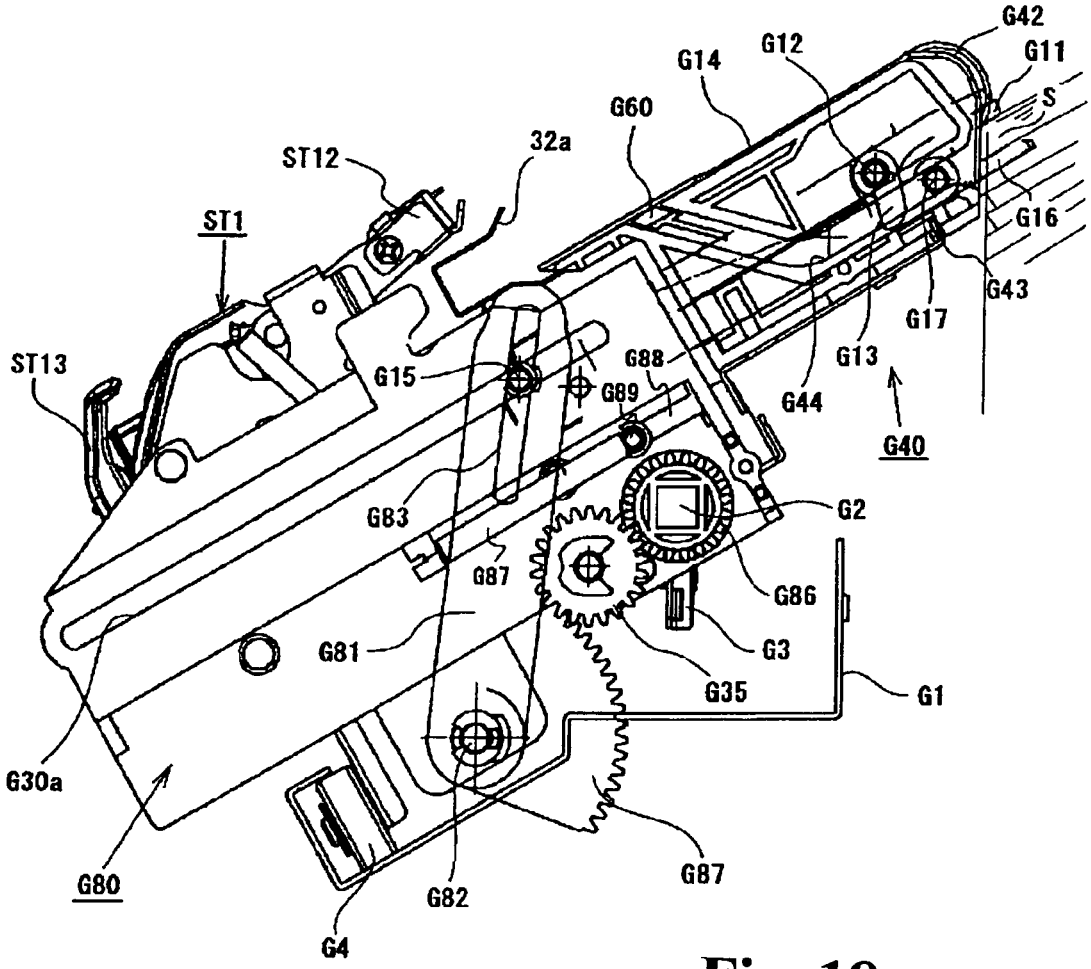
FIG. 18 illustrates a fifth grip-releasing position of the crank mechanism and the grip.

Under this condition, as shown in FIG. 18, the rotation axis G2 rectangular in cross section is reversely rotated by a crank mechanism KO shown in FIG. 9, thereby to turn the reciprocally turning lever G81 counterclockwise. By the turning of the reciprocally turning lever G81, the turning axis G17 of the grip parts G1 to G 20 is guided by the release guide G43 and taken in by the reciprocal guide G44. Concurrently, the sheet stack is mounted to the standing face of the discharge tray 21 under the aligning condition.

Figure 19:
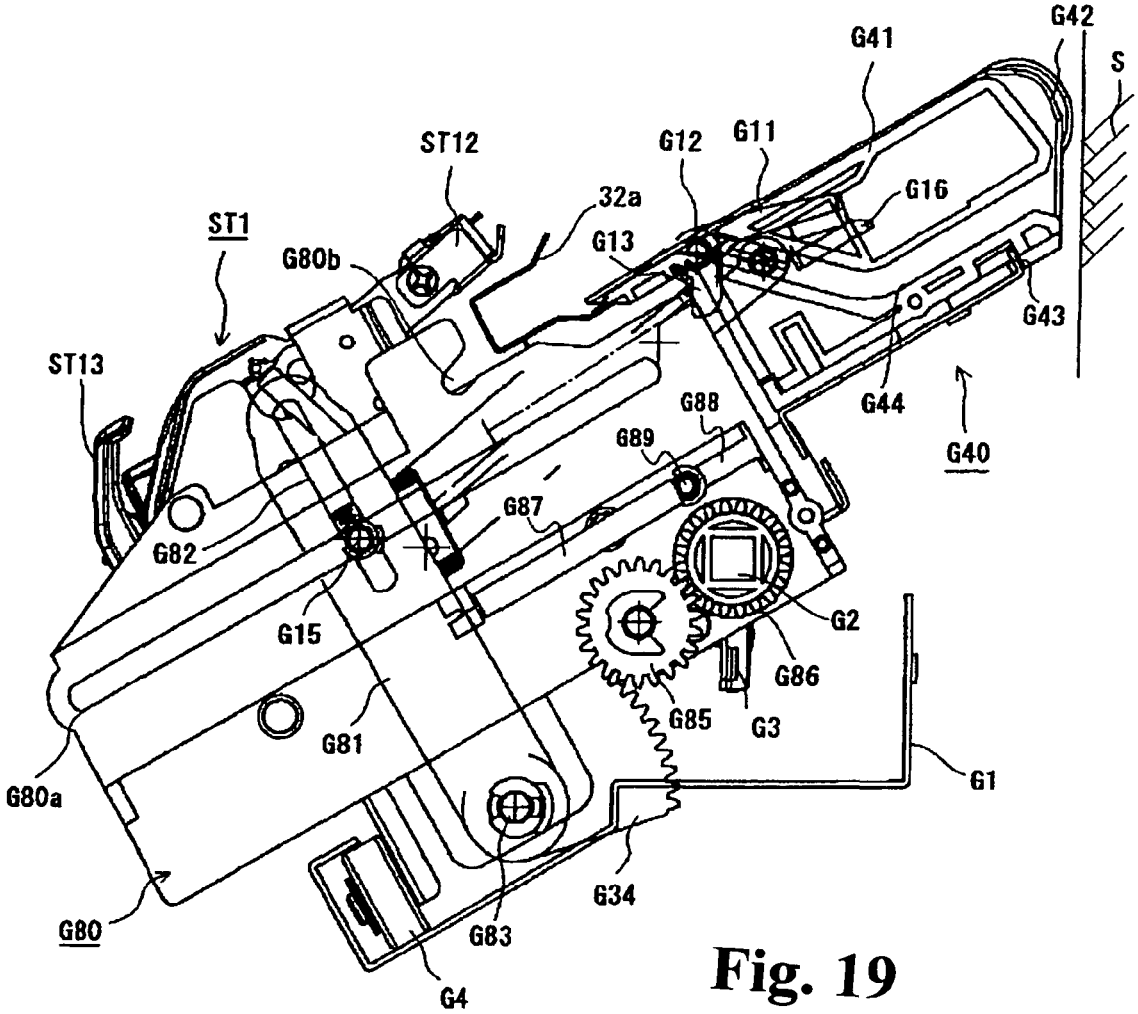
FIG. 19 is an illustration of an intermediate actuation when returning the crank mechanism and the grip.

The reciprocally turning lever G81 turns in the counterclockwise direction until the position shown in FIG. 19, and the turning axis G17 of the grip parts G1 to G 20 is returned on the reciprocal guide G41 while pushing the contacting oblique face G61 of one-direction regulating guide plate G60. The reciprocally turning lever G81 returns to the initial position, and the train of sheet stack discharging actuation is finished.

Although not illustrated, the grip parts G21 to 30 and G36 connecting the guide part G50, synchronize to grip the sheet stack and discharge to the sheet discharge tray 21.

Further, other than the guide parts G40, G50, for example, another third guide part is disposed to the sheet width center, and if alternate switching is performed in a case of appropriately moving the supporter 70 under the condition of gripping the sheet stack by the grip part and discharging the sheet stack by using the guide part G40 and the third guide part and another case of discharging the sheet stack by using the third guide part and the guide part G50 for discharging the sheet stack, an offset accumulation may be provided by appropriately sliding the sheet stack to be discharged on the sheet discharge tray 21.

Figure 20:
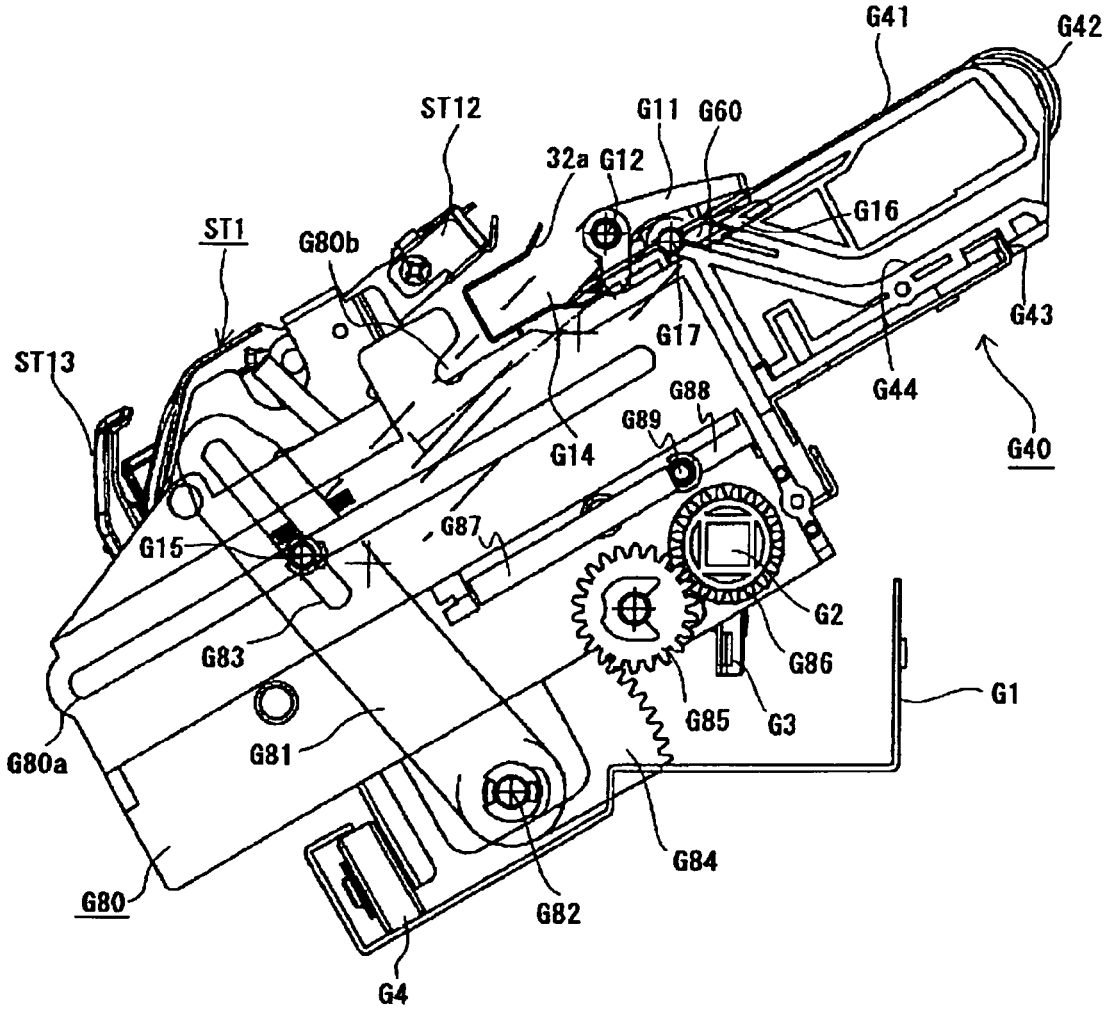
FIG. 20 illustrate a return motion of the crank mechanism and the grip.

FIGS. 14 to 20 show conditions of reciprocal movement of the crank mechanism. FIG. 14 shows an actuating condition of the grip part at the waiting position concerned with this invention, FIG. 15 shows an actuating condition of the grip part reaching a position of gripping the sheet stack, FIG. 16 shows an actuating condition of discharging the gripped sheet stack onto the upper position of the accumulation tray 29, FIG. 17 shows an actuating condition of soft-landing the discharged sheet stack on the mounting face of the accumulation tray 29, FIG. 18 shows an actuating condition of pushing the sheet stack at the end to the standing face 32*a* of the accumulation tray 29 and releasing grip, FIG. 19 shows an intermediately actuating condition of reciprocation of the grip part, and FIG. 20 shows an actuating condition of returning to the going path at reciprocation of the grip part.

Prior to explaining the actuations, referring to FIG. 9, explanation will be made in detail to the reciprocally moving mechanism of the reciprocally turning lever G81 and the crank mechanism K0 for controlling reciprocal movement of the grip parts G11 to G20. In the drawing, the crank mechanism K0 of changing rotation of the rotation drive motor M0 into reciprocal movement, is composed of a first gear K1 rotating by following rotation of the rotation drive motor M0, a second gear K2 adjusting rotation of the first gear K1 to be appropriate at rotating speed, a crank arm K5 rotatably supported at one end by an axis separately provided appropriately from the rotation center of the second gear K2 and at another end reciprocating, and a third gear K3 having the axis supporting said another end reciprocating with respect to the crank arm K5, and transmits reciprocal rotation of the third gear K3 to the first gear G86, G96 (refer to FIG. 6) being the drive gear of the above explained reciprocally turning lever G81, G91 (refer to FIG. 6).

Further, since the actuation speed of the third gear K3 reciprocally rotated by the crank arm K5 becomes a crank movement and becomes a function speed similar to a curve of a trigonometric function, the speed is controlled for the grip parts G11 to G20 to slowly mount the sheet stack onto the mounting face of the accumulation tray 29 by applying an initial stage of a reciprocal start point to the grip actuation of the grip parts G11 to G20, the grip parts G11 to G20 slowly grip the sheet stack at a degree of not breaking it down, and by applying to the lowering actuation to the mounting face of the accumulation tray 29 of the grip parts 11 to 20 gripping the sheet stack at a stage immediately before reaching to another reciprocal start point. That is, the crank mechanism K0 uses the reciprocally turning lever G81 to return the grip parts G11 to G20 to the first waiting position, after the regulation means successively moves along the first waiting position of opening to wait for accumulation of the sheets not to disturb accumulation of the sheets backward the accumulation position where the regulating means aligns to accumulate the sheets in stack, the second grip position of gripping the sheet stack aligned and accumulated by the regulating means, the third discharge position of gripping the sheet stack at the second grip position and moving upward of the mounting face of the accumulation tray, the fourth mounting position of mounting the sheet stack from the third discharge position onto the mounting face of the accumulation tray, and the fifth grip releasing position of pushing the sheet stack mounted on the mounting face of the accumulation tray to the standing face of the accumulation tray from the fourth mounting position onto the mounting face of the accumulation tray and releasing grip of the sheet stack.

With respect to the relation of moving speed to the above mentioned respective positions, as shown in FIG. 9, if determining a first moving speed V1 from the first waiting position P1 to the second grip position P2, a second moving speed V2 from the second grip position P2 to the third discharge position P3, a third moving speed V3 from the third discharge position P3 to the fourth mounting position P4, and a fourth moving speed V4 from the fourth mounting position P4 to the fifth grip releasing position P5, speed reduction is started at a point prior to reaching the third discharge position P3 in order to quietly mount the sheet stack discharged and not to break down the regularity property of the sheets mounted on the accumulation tray, and the second moving speed V2 is made the third moving speed V3. The grip actuation is carried out before reaching the second moving speed not to cause the sheet stack to break down when gripping the sheet stack.

Under the condition shown in FIG. 9, the turning axis G17 of the grip parts G11 to G20 separates from the guide part G40, and under this condition, the turning axis G17 is supported by a guide face (not shown) of the support frame G80 (refer to FIG. 6) not to rotate in the clockwise direction, and the turning axis G17 has a structure easily engaging the guide part G40. Owing to this structure, when the grip parts G11 to G20 separates from the guide part G40 and moves in the direction transverse with the sheet stack delivery direction, the grip parts G11 to G20 may move as keeping their postures.

Further, a control structure of the above image forming system will be explained referring to FIG. 21. The image forming system shown in FIG. 1 has a controller (called as "controller of the element" hereafter) 50 of the image forming apparatus A, and a controller (called as "controller of the post process" hereafter) 60 of the sheet post process apparatus B. The controller 50 of the element has an image forming controller 51, a sheet supply controller 52 and an input 53, and performs setting of "image forming mode" and "post process mode". The image forming mode determines, as mentioned above, copies of print-out, sheet size, color or monochrome print, enlarge or reduction print, both or one side print, and other image forming conditions. The controller 50 of the element controls the image forming controller 51 and the sheet supply controller 52 in response to the determined image forming conditions, forms images on desired sheets, and thereafter delivers in succession from the sheet outlet 3 of the element.

At the same time, the post process mode is determined by input from a control panel 18. The post process mode is set to, for example, "print out mode", "stapling finish mode" or "sheet stack bending-finish mode". Then, the controller 50 of the element transfers to the controller 60 of the post process information of the finish mode of the post process and the number of sheets, the upper side of copies and the binding mode (stop-binding of one position or of plural bindings more than two positions).

Further, the controller 60 of the post process has a control CPU 61 to cause the sheet post process apparatus B to actuate in response to a designated finish mode, ROM 62 storing actuation programs and RAM storing control data. This RAM 63 is prepared, in response to sizes of the sheets transferred to the sheet process path P2, with position data of sheet engaging positions Sh1, Sh2, Sh3 of the sheet front end regulating means 38, e.g., a data table. The control CPU 61 has a sheet delivery controller 64*a* executing delivery of the sheets sent to the sheet inlet 23, a sheet accumulation controller 64*b* executing sheet accumulation, a sheet binding process controller 64*c* executing the sheet binding process, and a sheet bending controller 64*d* executing sheet end bending process.

The sheet delivery controller 64*a* is structured to connect to a delivery roller 24 in the above mentioned sheet carrying-in path P1 and a control circuit of a drive motor M1 of the sheet discharge roller 25, and to receive detecting signals from a sheet sensor S1 disposed in this path. A sheet accumulation controller 64*b* is connected to a drive circuit of a reciprocally driving motor M2 for reciprocally driving roller 30 and for accumulating the sheets onto a first accumulation part (accumulation tray) and for a sheet discharge motor M3 of the back end regulating member 32. Further, a sheet binding process controller 64*c* is connected to a drive circuit of a drive motor M housed in an end binding staple apparatus ST1 of the accumulation tray 29 and a center binding staple apparatus ST2 of a second accumulation part (accumulation guide).

A sheet bending controller 64*d* is connected to a drive circuit of a roll drive motor M6 for driving to rotate bending rolls 45*a*, 45*b* and a control circuit of the clutch means 45*c*. The sheet bending controller 64*d* is connected to a control circuit of a shift means MS for moving the delivery rollers 36, 37 of the sheet carrying-in path 35*a* and the sheet front end regulating means 38 of the accumulation guide 35 to desired positions for receiving detection signals from the sheet sensors arranged in these paths.

The above structured controller causes the sheet post process apparatus B to execute the following processes.

a) Print Out Mode:

In this mode, the image forming apparatus A forms images of a series of documents, for example, from page 1, and delivers facedown in succession from the sheet outlet 3 of the element. The sheet post process apparatus B retreats a buffer guide 26 of the sheet carrying-in path P1 upward of FIG. 3 and moves a path switching piece 27 to a solid line. Thereby, the sheets sent to the sheet carrying-in path P1 are guided to the sheet discharge roller 25. After an estimate time when the sheets reach at the front ends the reciprocal roller 30 of the accumulation 29 by a signal having detected the sheet front ends at the sheet outlet 25*a*, the sheet delivery controller 64*a* brings down the reciprocal roller 30 from the upper waiting position onto the tray so as to rotate the reciprocal roller 30 in the clockwise direction in FIG. 4. Then, the sheets advancing on the accumulation tray 29 are delivered toward the first sheet discharge tray 21 by the reciprocal roller 30, and accumulated on the tray.

Further, in the print out mode, the sheets formed with images, by the image forming apparatus A, pass through the sheet carrying-in path P1 of the sheet post process apparatus B, and are accommodated upward of the first sheet discharge tray 21, for example, facedown in order of page 1 through page n. In this mode, the sheets are not guided to the first switch-back delivery path SP1 and the second switch-back delivery path SP2 (sheet process path).

b) Stapling Finish Mode:

In this mode, similar to the print out mode, the image forming apparatus A forms images of a series of documents from page 1 to page n, and delivers facedown in succession from the sheet outlet 3 of the element. The sheet post process apparatus B retreats the buffer guide 26 of the sheet carrying-in path P1 and moves the path switching piece 27 to a solid line, as depicted in FIG. 3. Thereby, the sheets sent to the sheet carrying-in path P1 are guided to the sheet discharge roller 25. After an estimated time, when the sheets reach the front end the reciprocal roller 30 of the accumulation 29 by a signal having detected the sheet front ends at the sheet outlet 25*a*, the sheet delivery controller 64*a* brings down the reciprocal roller 30 from the upper waiting position onto the tray so as to rotate the reciprocal roller 30 in the clockwise direction in FIG. 4. Subsequently, after the estimated time, when the sheets deliver at the front ends the accumulation 29, the sheet delivery controller rotates to drive the reciprocal roller 30 in the counterclockwise direction. Then, the sheets advancing from the sheet outlet 25*a* are switchback delivered onto the accumulation 29 along the first switchback delivery path SP1. By repeating the sheet delivery, a series of the sheets are facedown accumulated in stack on the accumulation tray 29.

Further, each time the sheets accumulate on the accumulation tray 29, the control CPU 61 causes a side aligning plate 34*b* to align the sheets in the width direction. Next, the control CPU 61 causes the end bind staple apparatus ST1 to actuate by a job end signal from the image forming apparatus A to bind the back end of the sheet stack accumulated on the accumulation tray 29. After this staple operation, the control CPU 61 moves the back end regulating member 32, also serving as a stack delivery means, from the position of the solid line to the position of the dotted line. Then, the stapled sheet stack is delivered on the first sheet discharge tray 21. Thereby, the series of sheets formed with images by the image forming apparatus A are stapled and accommodated in the first sheet discharge tray 21.

In this mode, the image forming apparatus A forms images on the sheets, for example, in the order explained with reference to FIG. 5, and the sheet post process apparatus B finishes in a booklet Therefore, the sheet post process apparatus B retreats the buffer guide 26 of the sheet carrying-in path P1 and moves the path switching piece 27 to a solid line as shown in FIG. 3. Thereby, the sheets sent to the sheet carrying-in path P1 are guided to the sheet discharge roller 25. Then, the control CPU 61 stops the sheet discharge roller 25 at a timing of the sheet back end having passed the path switching piece 27 on the standard of the signal detecting the sheet back end by the sheet sensor S1, and at the same time, moves the path switching piece 27 to the position of the dotted line in FIG. 3 (in the counterclockwise direction in FIG. 3). Then, the sheets advancing into the sheet carrying-in path P1 are changed in the delivery direction from the path switching piece 27 to a sheet entering path 35*a*, and guided to a curved guide part 35*b* by the delivery rollers 36, 37 disposed in this path.

Further, the control CPU 61 moves the sheet front end regulation means 38 to the position Sh1 while the sheets are delivered from the sheet advancing path 35*a* to the curved guide part 35*b*. The control CPU 61 moves the position of the sheet front end regulation means 38 to an optimum position in response to the sheet length from sheet size information (length in the delivery direction) from the image forming apparatus A and the position data stored in the RAM 63. Under this condition, the control CPU 61 causes the sheet side end alignment means 39 to aligns the sheets to the width-end (the width-end alignment may not be actuated for a first sheet and may not be actuated each time of the sheet advancing).

Subsequently, the control CPU 61 moves the sheet front end regulation means 38 to the position Sh3 of the sheet back end advancing into the switchback advancing path 35*c*. As shown in FIG. 12, the control CPU 61 moves the sheet front end regulation means 38 to the position Sh3 of the sheet back end advancing into the switchback advancing path 35*c* from the position data stored in RAM 63. Then, the sheet back end, supported by the accumulation guide 35 retreats to the switchback advancing path 35*c*. Under this condition, the succeeding sheets are sent from the sheet advancing path 35*a* to the curved guide part 35*b* and are piled on the preceding sheet. Matching with carrying-in of the succeeding sheets, the sheet front end regulation means 38 is moved from the Sh3 position to the Sh1 position.

The control CPU 61 causes the sheet side end alignment means 39 to actuate to provide the width end alignment of the carried in sheets and the sheets supported on the accumulation guide. By repeating the actuations, the sheets formed with image by the image forming apparatus A are performed with the set copies-justify.

When receiving a job end signal, the control CPU 61 moves the sheet front end regulation means 38 to the position Sh2, and sets positioning of the sheet center on the binding position X. After moving the sheet front end regulation means 38 to the position Sh2, the control CPU 61 sends a command signal for executing the staple actuation to the center binding staple apparatus ST2. Then, the staple apparatus carries out stapling on one or plural positions.

The control CPU 61 moves the sheet front end regulation means 38 to the position Sh1 with a signal for ending the stapling operation, and sets positioning of the sheet center on the binding position Y. The bending process is performed on the sheet stack to deliver to the second sheet discharge tray 22.

An embodiment of the present invention shows the center binding staple apparatus ST2 placed at the binding position X on the above mentioned accumulation guide 35, but the sheet processing path may be also structured to arrange in order such as accumulation guide, binding position, bending position, and the accumulation guide means, subsequently the staple apparatus, and sheet bending means at the downstream side of the staple apparatus. Further, it is also possible to bend the sheet stack without binding process by the center binding staple apparatus ST2 for delivering to the second sheet discharge tray 22.

An embodiment preventing actuation of the grip means will be explained with reference to FIG. 22. In the guide groove G80*a* formed in the above mentioned accumulation tray 29, a detection means 65 is arranged at a place prone to foreign materials for detecting them. The actuation means G8 is provided with a control means 66 (refer to FIG. 22) for stopping the grip means G10 moving when the foreign material enters into the guide groove G80*a*.

Figure 22:
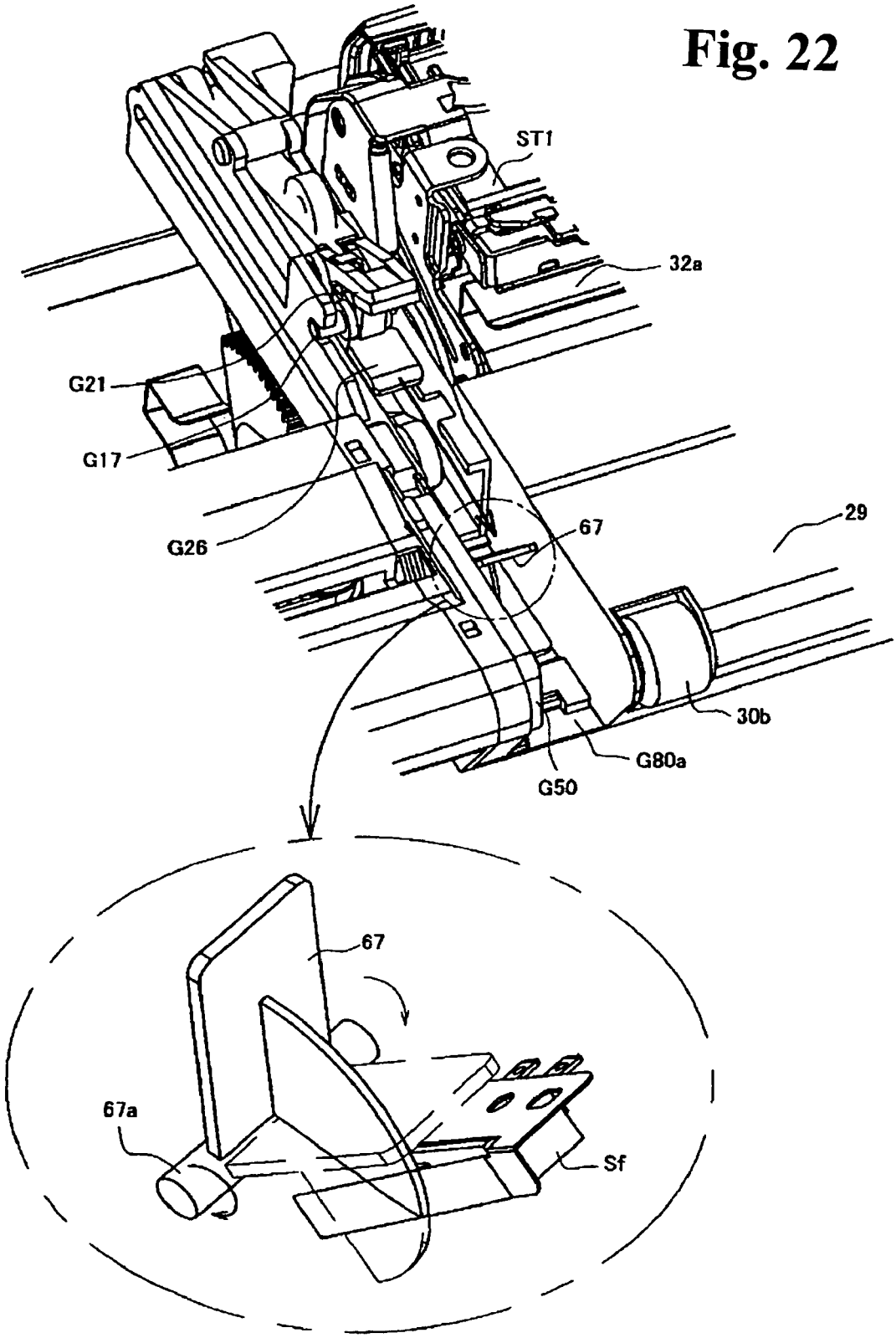
FIG. 22 shows a detection means in FIG. 5 and an enlarged view of the structure.

As shown in FIG. 22, the guide groove G80*a* is disposed with a rotational shutter plate 67 within a locus (shown with an arrow) of the grip means G10. The shutter plate 67 is pivoted at the back side of the accumulation tray 29 to be rotated by a shaft 67*a*. The center of gravity is determined or an urging spring is housed in for biasing the guide groove 80*a* in closed position. Accordingly, the shutter plate 67 rotates the grip means G10 in the clockwise direction or rotates around the shaft 67*a* when the foreign material (an operator's finger or office instruments; the same in the following) goes into the groove.

Further, the shutter plate 67 is integrally provided with a flag piece 68, and a photo sensor Sf is furnished at the back side of the accumulation tray 29 for detecting the flag piece 68. Therefore, when the grip means passes the guide groove G80 or the foreign material enters into the groove, the photo sensor Sf detects it. A detection signal of the photo sensor Sf is connected to the control means 66. When the grip means G10 reaches from the process position P1 (home position; the position is detected by a not shown home position) as shown in FIG. 9 to the shutter plate 67, the control means 66 indicates as normal when the photo sensor is turned ON, and indicates as "foreign material entering" when the photo sensor is turned ON in other cases.

The control means 66 turns OFF (shut down) an electric source of the drive motor M0. At the same time, the control means 66 issues a stop signal for the post process operation to the post process means D. Being different depending on the structures, in case of a later mentioned staple means, the post process means D is so structured as to move the binding unit (a later mentioned end binding staple apparatus ST1) in the sheet width direction and thereafter execute the binding process. Therefore, when judging "foreign material entering" by a signal from the photo sensor Sf, the control means 66 prevents the staple means ST1 to move in the sheet width direction and the binding actuation. The photo sensor Sf is sufficient with a mechanical switch, and in this case, the power source is forcibly shut down.

Figure 23:
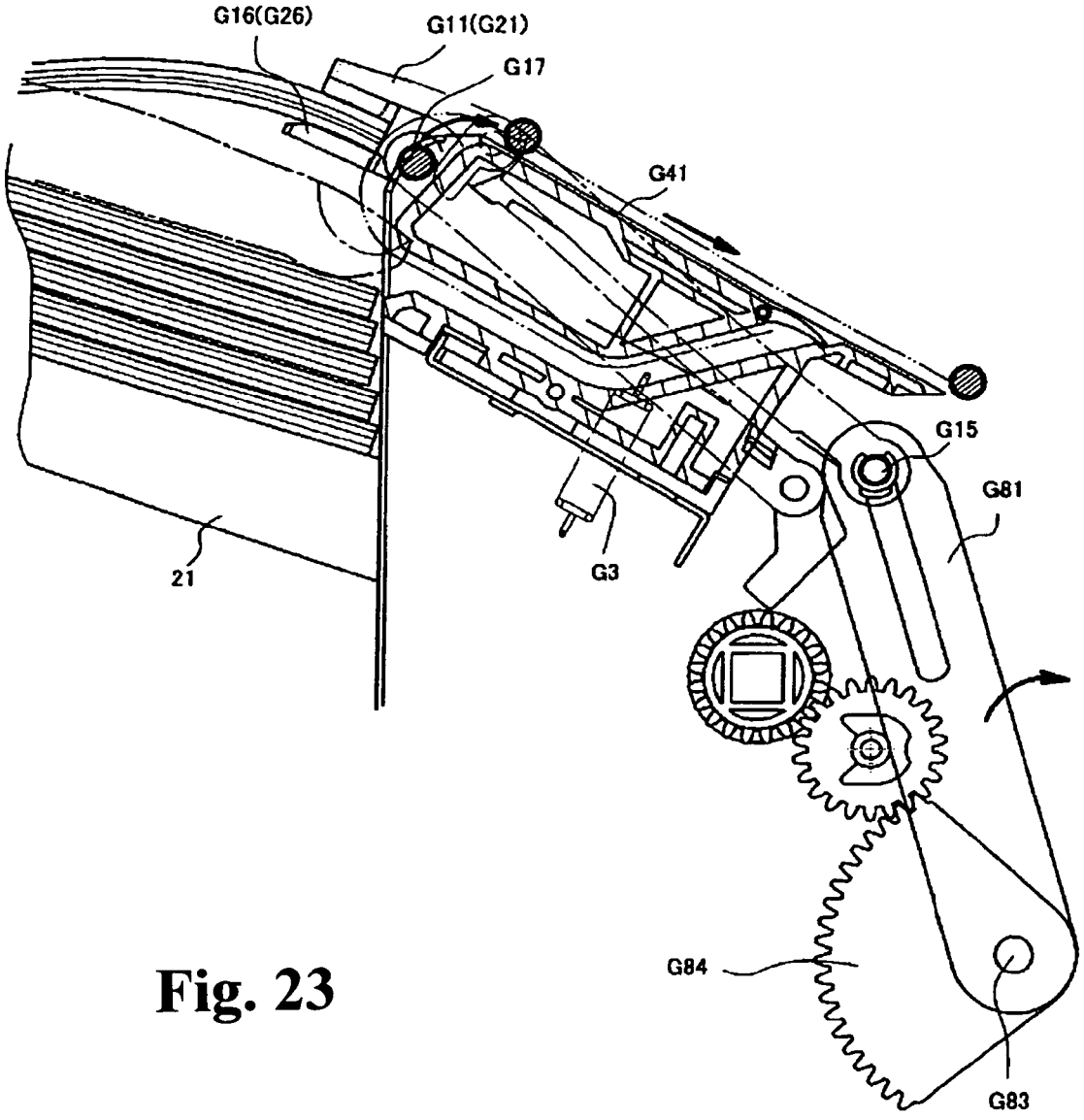
FIG. 23 illustrates the grip when foreign materials go into the guide groove.
Figure 24:
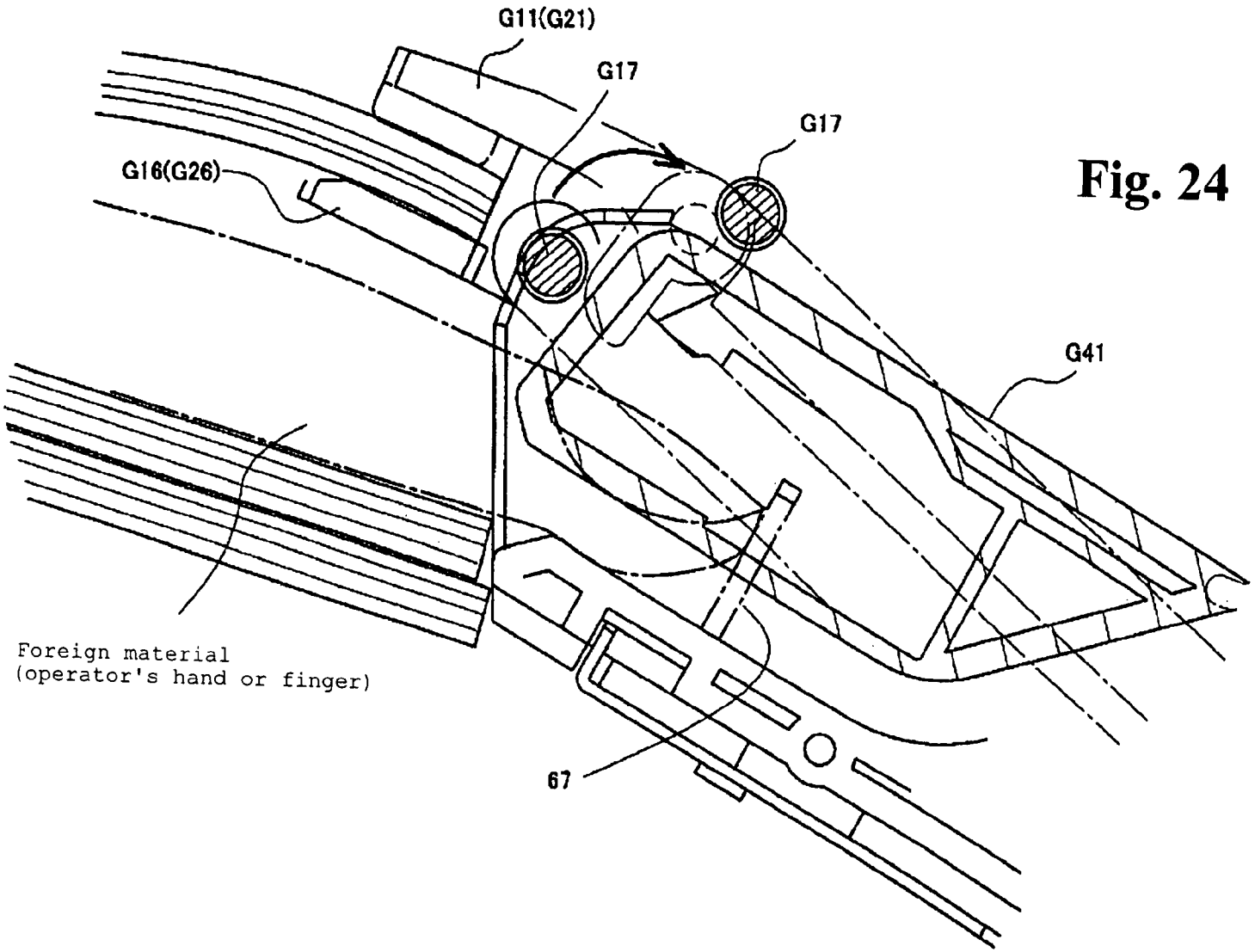
FIG. 24 shows an exploded view of the elementary part of FIG. 18.

Further, explanation will be made to an embodiment for bringing back the grip means to the binding position with reference to FIGS. 23 and 24. As shown in FIG. 9, the grip means G10 moves from the process position P1 to the discharge position P3 by an upper path G41 (G51) along the cam groove G40 (G50) formed in a closed loop. The grip means G10 at the discharge position P3 shifts to a lower path G44 (G54), and returns from the discharge position P3 to the process position P1 along the lower path G44 (G54). At this time, if the foreign material is present on the uppermost sheet, it interferes with the grip means G10. This condition is shown in FIG. 24, and the grip means G10 contacts the foreign material (finger shown in the same) and is moved to the lower path G44 (G54).

The illustrated apparatus depends upon actuation of the urging spring G3 with respect to the drive force shifting the guide pin G17 of the grip means G10 from the upper path G41 (G51) to the lower path G44 (G54). Accordingly, when the moving load of the grip means G10 exceeds the urging force of the urging spring G3 (exceeds a predetermined load), the guide pin G17 retreats to the upper path G41 (G51). Then, as shown in FIG. 24, if the drive motor M0 is rotated in an opposite direction, the guide pin G17 placing at the upper path G41 (G51) goes back on this path (not passing the lower path) to the process position P1. Thus, when the moving load exceeds the predetermined load, the grip means G10 goes back on the going path G41 (G51) to the initial process position P1. Further, if the grip means G10 does not return, inconvenience by drawing in can be avoided. Therefore, any destructive power more than the predetermined force (spring force) does not act on the foreign material such as the finger.

Further, in the sheet post process apparatus according to an embodiment of the present invention, the grip part has the structure removably connecting the guide part, whereby the grip part can move in along with the post process means and does not interfere with the movement of the post process means.

Further, by making the post process means and the grip part unitary/integral, the grip part is moved by using a moving mechanism of the post process means, the moving mechanism can be simplified in structure, and as a result, the apparatus can be made compact.

In addition, since the post process means and the grip part do not actuate simultaneously, the grip part can be controlled to move by using the drive motor moving the post process means to the post process position, and the drive mechanism is simplified and at the same time, the drive control is made easy.

The movement of the post process means and the grip means is transverse with respect to the discharging direction and is performed by the single drive motor, so that the apparatus can be made further compact.

The grip part is connected to the crank mechanism disposed within the moving space range in the direction transverse with the discharging direction of the post process means for carrying out the drive of discharging the sheets to the sheet discharge tray, and therefore, an arranging space for the crank mechanism is made unnecessary.

Further, arranging the grip part by utilizing an outside width of the post process means, more space is not required, the two grip parts can be spaced with appropriate distance, and the apparatus can be made compact.

In the sheet post process apparatus according to an embodiment of the present invention, the grip means which grip the sheet stack accumulated on the accumulation tray and discharge onto the discharge tray, are arranged to enable to grip the sheet stack at the accumulation position of the sheet stack aligned by the regulation means, and are reciprocally supported in the direction transverse to the discharging direction of the sheet stack onto the discharge tray, and the grip means open more widely than the frontage of the regulation means, whereby it is unnecessary to retreat the regulation means from the moving loci of the grip means when moving the grip means. Therefore the mechanism is simplified and the apparatus can be made compact.

The sheet stack is discharged as gripped by the grip parts, so that discharging under offset of the sheet stack on the discharge tray is possible.

Further, in the sheet post process apparatus according to an embodiment of the present invention, with the crank mechanism for causing the grip parts to engage with the guide path and to reciprocate, when gripping the sheet stack, the gripping is quietly actuated not to disturb the regularity of the sheet stack, and while moving the sheet stack to the discharge position, it is done with an increased speed, and when discharging the sheet stack onto the discharge tray, it is performed at a high speed and with good regularity.

The first moving speed from the waiting position to the grip position is lowered, regularity of the sheet stack accumulated by the regulation means is prevented from destruction, and the moving speed from the grip position the discharge position is increased, it is made possible to promptly discharge the sheet stack from the process tray to a subsequent process of the sheet accumulation tray, so that the post process is smoothly performed and the process speed can be increased.

In the sheet post process apparatus according to the present invention, since the moving speed from the grip positions to the discharge position is set to be higher than the speed of the sheet stack from the discharge position to accumulation onto the accumulation tray, the sheet discharge process having excellent regularity of the sheet stack is possible. Since the grip parts are set to grip the sheet stack on the accumulation tray at the lower speed than the moving speed from the grip positions to the discharge position, the regularity of the sheet stack is not disturbed when gripping.

The speed control of the grip parts is set by crank actuation of the crank mechanism, so that complicated motor rotation control is not required.

In a prior circulation belt system, the present invention only installs the guide member the grip members to the accumulation tray, thereby to enable to guide the reciprocal movement of the grip members and to simplify the moving mechanism of the grip members and the structure.

Further. by providing the reciprocal grip means with the disengaging member and the guide member, movement can be made easy by separating the grip members from the guide members, and the grip members can be retreated therefrom, when necessary.

Furthermore, in the sheet post process apparatus according to an embodiment of the present invention, when delivering the sheet stack on the accumulation tray from the process position to the delivery position, if the foreign material goes into the guide grooves of the grip means delivering the sheet stack or into the moving loci of the grip means, the grip means are prohibited from moving or retreated to the process position, so that if the foreign material or the operator's finger goes into the guide grooves, the detection means detects it, and since the grip means delivery and/or the post process apparatus operating are prohibited (stopped), the post process apparatus can be safely operated. In particular, even if the operator's finger goes into the guide grooves, the finger is not injured because the grip means are stopped. A structure for such events is provided with a detecting means for detecting the foreign material, and stops (for example, stopping the power source of the drive motor) the grip means driven by the signal from the detecting means. Therefore, the apparatus is very simple in the structure.

The grip means whirling along the accumulation tray is structured to go back to the side of the process position if the foreign material or the operator's finger goes into the moving loci, and even if the operator's finger or the material are kept between the grip means, since the grip means go back, the operation is at once released and the finger or the material can be removed. The structure for such events is sufficient to go back to the process position in response to the moving load of the grip means.

This application is based on, and claims priorities to, Japanese Patent Applications No. 2007-116995, No. 2007-116996, No. 2007-116997, No. 2007-116998, and No. 2007-1169021, the contents of which are incorporated herein by reference.

While the invention has been explained with reference to the specific embodiments of the invention, the explanation is illustrative and the invention is limited only by the appended claims.

What is claimed is:

1. A sheet post processing apparatus, comprising:

a process tray for aligning and accumulating sheets delivered in succession;

staple means disposed on the process tray at a post processing position for post processing the sheets on the process tray, and reciprocally movably arranged in a sheet width direction transverse with a sheet discharging direction of a post processed sheet stack on the process tray;

a sheet discharging stacker arranged at a downstream side of the process tray for accumulating and accommodating the post processed sheet stack; and sheet stack delivery means for delivering the post processed sheet stack on the process tray from the process tray to the sheet discharging stacker, the sheet stack delivery means comprising a pushing member which engages the sheet stack on the process tray and transfers the sheet stack in a discharge direction, guide means for guiding the pushing member in the sheet discharging direction along the process tray, and drive means for reciprocally moving the pushing means along the guide means, wherein the pushing member is arranged such that when the sheet stack is delivered to the sheet discharging stacker, the pushing member engages the guide means and moves along the guide means by the drive means, and at a predetermined position, the pushing member is separated from the guide means and is movable in the sheet width direction.

2. The sheet post processing apparatus according to claim 1, wherein the process tray is provided at the post processing position with a movable frame moving in the sheet width direction, the movable frame is mounted with the staple means and the pushing member respectively, and the pushing member is, at the post processing position, separable from the guide member and is movable in the sheet width direction.

3. The sheet post processing apparatus according to claim 2, wherein the movable frame is provided with a drive motor for moving a position of the frame in the sheet width direction, and the staple means and the pushing member are moved in the sheet width direction by the drive motor.

4. The sheet post processing apparatus according to claim 1, wherein the sheet stack delivery means further comprises gripper means for gripping the sheet stack at an end and delivering in the sheet discharging direction from the post process position to a sheet discharge position; and the driving means reciprocates the gripper means along the process tray, where the process tray is provided with a guide groove for guiding the gripper means from the post process position to the discharge position;

the gripper means are structured to reciprocate along the guide groove, and when a foreign material goes into the guide groove or a moving loci of the gripper means, the gripper means is prevented from moving, or the gripper means is retreated to the process position.

5. The sheet post processing apparatus according to claim 4, wherein the actuation means is configured to retreat the gripper means toward the process position in response to a moving load of the gripper means when the foreign materials go into the moving locus.

6. The sheet post processing apparatus according to claim 5, wherein the gripper means includes a cam groove for regulation between the process position and the delivery position, the cam groove is configured to guide the gripper means to draw a closing loop loci between a going path at an upper position of the process tray and a returning path at a lower position, and when the foreign material goes between the gripper means moving to the delivery position and the sheets accumulated on the stack means, the actuation means returns the gripper means from the delivery position to the process position along the going path.

7. The sheet post processing apparatus according to claim 4, further comprising detection means installed in the guide groove for detecting a foreign material, and control means installed at the actuation means for stopping the gripper means from moving when the foreign material goes into the guide groove by a signal from the detection means.

8. The sheet post processing apparatus according to claim 7, wherein when the foreign material goes into the guide groove, the control means issues a signal for at least stopping the staple means moving in the sheet width direction or actuating the post process by the signal from the detection means.

9. An image forming system, comprising:

an image forming apparatus for sending sheets formed with images, and the sheet post processing apparatus according to claim 1 for performing a post process on the sheets successively delivered from the image forming apparatus.

10. A sheet post processing apparatus, comprising:

a process tray for aligning and accumulating sheets delivered in succession;

staple means disposed on the process tray at a post processing position for post processing the sheets on the process tray, and reciprocally movably arranged in a sheet width direction transverse with a sheet discharging direction of a post processed sheet stack on the process tray;

a sheet discharging stacker arranged at a downstream side of the process tray for accumulating and accommodating the post processed sheet stack; and sheet stack delivery means for delivering the post processed sheet stack on the process tray from the process tray to the sheet discharging stacker, the sheet stack delivery means comprising a pushing member which engages the sheet stack on the process tray and transfers the sheet stack in a discharge direction, guide means for guiding the pushing member in the sheet discharging direction along the process tray, and drive means for reciprocally moving the pushing means along the guide means, wherein the pushing member is arranged such that when the sheet stack is delivered to the sheet discharging stacker, the pushing member engages the guide means and moves along the guide means by the drive means, and at a predetermined position, the pushing member is separated from the guide means and is movable in the sheet width direction, and wherein the staple means and the pushing member are arranged to be moved simultaneously in the width direction, the pushing member is composed of a gripper member for nipping a back end of the sheet stack on the process tray, and the guide means has a guide groove for guiding the gripper member from the post processing position to the discharging stacker.

11. The sheet post processing apparatus according to claim 10, wherein the pushing member has a turning arm connected to a drive motor, a lengthwise lever attached to the turning arm and guided by the guide groove, and the gripper member mounted on the lengthwise lever.

12. The sheet post processing apparatus according to claim 10, wherein the pushing member has a pair of pushing elements, each of the pushing elements having a turning arm connected to a drive motor, a lengthwise lever connected to the turning arm and guided by engaging the guide groove and the gripper member mounted on the lengthwise lever.

13. The sheet post processing apparatus according to claim 10, wherein the process tray is provided with sheet regulating means for positioning the sheets carried successively into the post processing position, the sheet regulating means has a stack thickness regulating member for allowing the sheet stack having a thickness less than a predetermined thickness to align in the process tray, and the gripper member opens wider than the stack thickness aligning member to grip an end of the sheet stack.

14. The sheet post processing apparatus according to claim 10, wherein the gripper member is arranged to successively move along the process tray in an order of a waiting position, a nipping position, a discharging position, a landing position and a nip releasing position, the waiting position being set at a position not to prevent carrying-in of the sheets retreating from the post process position on the process tray, the nipping positions being set at a position for gripping the sheet stack post-processed on the post process position, the discharging position being set at a position for discharging the sheet stack from the process tray to the discharging stacker, the landing position being set at a position for accumulating to store the sheet stack on the sheet discharging stacker, and the nip releasing position being set at a position for separating the grip member from the sheet stack accumulated and stored on the sheet discharging stacker.

15. The sheet post processing apparatus according to claim 14, wherein the gripper member has a first moving speed for moving the sheet stack from the waiting position to the nipping positions, a second moving speed for moving the sheet stack from the nipping position to the discharging position, a third moving speed for moving the sheet stack from the discharging position to the landing position, and a fourth moving speed for moving the sheet stack from the landing position to the nip releasing position, at least one of the first to fourth moving speeds being different from other moving speeds.

16. The sheet post processing apparatus according to claim 15, wherein the gripper member has a grip portion gripping the sheet stack, the grip portion moving to a grip position for gripping the sheet stack on the accumulation tray, a discharge position for discharging the sheet stack to an upper part of the discharge tray, and a place position for placing the sheet stack discharged on the discharge position on the discharge tray, wherein the gripper member moves from the grip position to the discharge position higher than a moving speed from the discharge position to the placing position.

17. The sheet post processing apparatus according to claim 15, wherein the gripper member grips the sheet stack on the accumulation tray at a speed lower than the moving speed from the grip positions to the discharge position.

18. The sheet post processing apparatus according to claim 15, wherein the moving mechanism further comprises a crank mechanism which changes a rotation of the drive motor rotating in one direction into a reciprocal movement of the grip part, and a movement and moving speed of the gripper member are determined by a crank actuation of the crank mechanism.

19. The sheet post processing apparatus according to claim 15, wherein the sheet discharge tray has a standing face for regulating a back end of the sheet stack in the discharge direction, and the gripper member is successively guided by the moving mechanism to the grip position for gripping the sheet stack on the accumulation tray, the discharge position for discharging the sheet stack to an upper part of the discharge tray, and the place position for placing the sheet stack discharged on the discharge position on the discharge tray.

20. The sheet post processing apparatus according to claim 15, wherein the gripper member is further guided to the waiting position behind the accumulation tray, and is released from the guide means at the waiting position.

* * * * *